US005195062A

United States Patent [19]

Sase et al.

[11] Patent Number: 5,195,062

[45] Date of Patent: Mar. 16, 1993

[54] DISPLAY DEVICE

[75] Inventors: Masahiro Sase; Kiyotaka Igarashi; Takashi Osa, all of Tokyo; Noritoshi Suzuki, Saitama, all of Japan

[73] Assignee: Citizen Watch Co., Ltd., Tokyo, Japan

[21] Appl. No.: 445,640

[22] PCT Filed: Apr. 4, 1989

[86] PCT No.: PCT/JP89/00358

§ 371 Date: Nov. 16, 1989

§ 102(e) Date: Nov. 16, 1989

[87] PCT Pub. No.: WO89/09950

PCT Pub. Date: Oct. 19, 1989

[30] Foreign Application Priority Data

Apr. 5, 1988 [JP] Japan ..... 63-82318

[51] Int. Cl.[5] ..... G04B 19/26; G04C 19/00

[52] U.S. Cl. ..... 368/21; 368/82; 368/113

[58] Field of Search ..... 368/21-24, 368/27, 28, 37, 223, 228, 232

[56] References Cited

U.S. PATENT DOCUMENTS 2,910,825 11/1959 Kirkwood ..... 368/21
4,464,058 8/1984 Weller ..... 368/21
4,847,819 7/1989 Hong ..... 368/21

FOREIGN PATENT DOCUMENTS 58-27085 2/1983 Japan .
63-106592 5/1988 Japan .
63-298089 5/1988 Japan .

*Primary Examiner*—Vit W. Miska
*Attorney, Agent, or Firm*—Koda and Androlia

[57] ABSTRACT

A hand display device having a hand driven by a pulse motor in which graduations or symbols representing plural types of functions to be indicated by the hand are arranged so as to display the mutal positions on a dial, and by selecting one of the functions, the hand stays at a position of graduation or symbol corresponding to a selected function for a relatively longer time than that corresponding to unselected function to display functional display selectively.

6 Claims, 10 Drawing Sheets

DIAL
100
MINUTE HAND
92
HOUR HAND
91
SEC
STOPW.
MIN
STOPW.
1/10&H
STOPW.
94
STOPW.
SECOND
HAND
95
STOPW. MINUTE HAND
93
SECOND HAND
104
105
101
SWITCHOVER
HAND
106
103
102
107

COMMON
NUMERAL
106
107 COMMON
GRADUATION
STOPW.
HOUR
NUMERAL
103
STOPW.
1/10-SECOND
NUMERAL
102
1/10 & H
STOPW.
STOPW.
1/10-SECOND
GRADUATION
104
105
STOPW. HOUR
GRADUATION
101
SWITCHOVER
HAND

P301
300
301
302
303
304
305
306
307
308
309
310
311
312
P307
P308
P309
P310
P311
P312
Vdd
Vss
313
314
315
316
317
318
319
320
321
322
324
325
326
327
330
331
332
333
334
335
336
337
338
339
340
341
342
343
344
345
346
347
348
349
350
351
352
353
354
355
356
357
358
P314
P318
P324
P325
P328
P330
P331
P332
P333
P339
P340
P352
P353
I
Q
R

DISPLAY DEVICE

TECHNICAL FIELD

This invention relates to a hand display device using a hand for display. More particularly, this invention relates to a technology for switching a single hand to display more than one function in the event of a small-sized hand display device such as an electronic hand display watch with limited space.

BACKGROUND

Hand display devices have a long history of growth, and they already existed before the hand has been electronically controlled. Taking a familiar example, a cooking spring scale for weighing cooking material was not electronically controlled, of course. Then with the advent of the electronics age, electronic control has been playing a major role. Among all, as a basic measuring instrument, there are hand indicating testers for measuring the value of resistance and the value of voltage. Since these hand indicating testers are compact, most of them are switched over to display either the value of resistance or the value of voltage by means of single hand. Also in the resistance measuring mode, a switch for changing the range is provided, and by using the different ranges depending on the magnitude of resistance of the object to be measured, the graduations are always easy to read by means of a hand, and also the mode can be distinguished by a direction pointed by a range control knob, thus having the user read the graduation corresponding to the mode. This hand indicating tester is an early instrument which has used a single hand by switching it for displaying more than one function. In addition, as a typical example of a compact hand display device using a single hand by switching it for displaying of more than one function, there is an electronic hand display watch.

In recent years, like electronic digital watches, electronic hand analog display watches are equipped with various functions, and multi-functioning has been advancing and realized. As already commercialized products, electronic hand display watches with an alarm function, a stopwatch function, a timer function, et cetera are available.

Furthermore, there is a demand for an electronic hand display watch with various functions, but there is a limit to the number of hands in its restricted space.

An electronic hand display watch in which a single hand displays more than one function has been devised, too.

One example of a hand display device of a conventional electronic hand display watch wherein a single hand displays more than one function will be described with reference to FIGS. 9, 10 and 11.

This example is an electronic hand display watch with a stopwatch (ST) function for measuring the stopwatch 1/10-seconds, stopwatch second, stopwatch minute and stopwatch hour. For measuring stopwatch second and stopwatch minute, a stopwatch second hand and a stopwatch minute hand are provided, respectively. However, for the two functions, the stopwatch 1/10-second and stopwatch hour, a single hand is used by switchover. Such a single hand displays stopwatch 1/10-seconds when the stopwatch measuring time is in the less than 60 minute mode and hours when in the 60 minute or more mode.

Within one second after 9 hours 59 minutes and 59 seconds of the stopwatch measuring time, the display returns to 0 minutes 0 seconds 0. At this time, the hand display function is switched again to the original stopwatch 1/10-second time display. A mode hand is provided, so that after the stopwatch function has ceased, the user can correctly determine whether he or she should read the graduation as the stopwatch 1/10-second in the less than 60 minute mode or as the stopwatch hour in the 60 minute or more mode.

First, FIGS. 9 and 10 are referred to. FIG. 9 is a view showing a dial 900 and hands which form the face of a conventional electronic hand display watch, and FIG. 10 is a partially enlarged view of FIG. 9. On the dial 900, an hour hand 91, a minute hand 92 and a second hand 93 for displaying usual time are attached at the center, and around which a stopwatch second hand 94 for displaying the seconds, a stopwatch minute hand 95 for displaying the minutes, a switchover hand 96 for displaying the 1/10-seconds and the hours, and a mode hand 97 for displaying the modes are attached as smaller hands. On the peripheral portion of the dial 900 indicated by the switchover hand 96, as enlarged in FIG. 10, stopwatch 1/10-second numerals 98 necessary for reading the 1/10-seconds are arranged at the outermost position, and stopwatch hour numerals 99 necessary for reading the hours are arranged inside. At the innermost position, graduations 90 to be used for both 1/10-seconds and hours are arranged.

FIG. 11 is a block diagram of a circuit of a conventional electronic hand display watch, in which like reference numerals designate like or corresponding parts in FIG. 9, and the explanation will be omitted. In FIG. 11, a time reference source 1 produces a time reference signal P1 (32,768 Hz); a frequency dividing circuit 2 for time, which receives time reference signal P1 from the time reference source 1 for making a reference for usual time, comprises plural stages of frequency dividers and produces a signal group of time frequency division signals P2 for making a 1 Hz usual drive pulse period and pulse width; a usual time signal generating circuit 11 produces a usual time pulse P11 under a predetermined frequency division signal P2 of the frequency dividing circuit 2 for time; and a first drive circuit 16 produces a usual time driving signal P16 for usual time driving under the usual time pulse P11. The usual time driving signal P16 is applied to a first motor 21, then drives the second hand 93 which interlocks with the first motor 21, and makes the second hand 93 display the usual time, together with the minute hand 92 and the hour hand 91, which mechanically interlock with the second hand 93 by means of train mechanism.

A switching circuit 4 comprises a start/stop switch 41, a chattering preventing circuit 42 and a toggle type flip-flip 43 (operated by a rising signal applied to an input terminal T and hereinafter referred to as "T-FF"). The start/stop switch 41 interlocks with an external control member and produces a start/stop signal P41 every time the stopwatch start operation and stop operation are performed. The chattering preventing circuit 42 receives the start/stop signal P41 and produces, every stopwatch start and stop operation, a one shot signal P42 in which a mechanical chattering of the start/stop switch 41 has been eliminated. The T-FF 43 receives the one shot signal P42 at input terminal T and produces, from its output terminal Q, a switching signal P4 which is at an "L" level in the stopwatch stop condition and a "H" level in the stopwatch start condition.

The level of this switching signal P4 is inverted every stopwatch start and stop operations.

A stopwatch circuit 30 comprises a stopwatch frequency dividing circuit 3, an inverter ("INV") 31 and a data type flip-flop 32 ("D-FF"). The stopwatch frequency dividing circuit 3 comprises a frequency divider of plural stages for making a reference of the stopwatch. An input terminal I of the stopwatch frequency dividing circuit 3 receives the time reference signal P1 from the time reference source 1, and a reset terminal R is controlled by a stopwatch frequency division enable signal P32 from the D-FF 32. In the stopwatch function stop state, under the stopwatch frequency division enable signal P32 at the "H" level, the frequency divider is reset, the frequency dividing operation is not performed, and the outputs of a stopwatch frequency division signal group P3 and a 16 Hz frequency division signal P34 are stopped. On the other hand, in the stopwatch function start state, under the stopwatch frequency division enable signal P32 at the "L" level, the stopwatch frequency dividing operation is performed, and the stopwatch frequency division signal group P3 for making the pulse periods and pulse widths of the stopwatch second, stopwatch minute, stopwatch 1/10-second and stopwatch hour and the 16 Hz frequency division signal P34, are produced. Also, the D-FF 32 reads in the data information at its input terminal D by the rising timing of the signal to be applied to its input terminal T. The input terminal D receives the inverted switching signal P4, the input terminal T receives the 16 Hz frequency division signal P34, and an input reset terminal R receives the switching signal P4.

A stopwatch second signal generating circuit 12 produces a 1 Hz stopwatch second pulse P12 in response to the first signal of the frequency division signal group P3 of the stopwatch frequency dividing circuit 3 in the stopwatch start state. A second drive circuit 17 which produces a stopwatch second driving signal P17 in response to the second pulse P12. The stopwatch second driving signal P17 is applied to a second motor 22 to drive the stopwatch second hand 94 which interlocks with the second motor 22 and displays stopwatch seconds.

A stopwatch minute signal generating circuit 13 produces a stopwatch minute pulse P13 at an interval of one minute in response to the second signal of the stopwatch frequency division signal group P3 of the stopwatch frequency dividing circuit 3 in the stopwatch start state. A third drive circuit 18 produces a stopwatch minute driving signal P18 in response to the minute pulse P13 in the stopwatch start state. The stopwatch minute driving signal P18 is applied to a third motor 23 to drive the stopwatch minute hand 95 which interlocks with the third motor 23 and displays stopwatch minutes.

A stopwatch 1/10-second signal generating circuit 14 produces a stopwatch 1/10-second pulse P14 of 10 Hz in response to the third signal of the stopwatch frequency division signal group P3 of the stopwatch frequency dividing circuit 3 in the stopwatch start state. A stopwatch hour signal generating circuit 15 produces a stopwatch hour pulse P15 at an interval of one hour in response to the fourth signal of the stopwatch frequency division signal group P3 of the stopwatch frequency dividing circuit 3 in the stopwatch start state.

A mode control circuit 5 comprises a base-60 counting section 51, a base-10 counting section 52 and a data type flip-flop 53 (which reads in data information at an input terminal D by the rising timing of a signal applied to an input terminal T; hereinafter called "D-FF"). When the base-60 counting section 51 counts "60" in response to the stopwatch minute pulse P13 of the stopwatch minute signal generating circuit 13, it produces a one-shot stopwatch 60-minute signal P51. In other words, the stopwatch 60-minute signal P51 is produced every 60 minutes in the stopwatch start state. When the base-10 counting section 52 counts "10" in response to the stopwatch hour pulse P15 of the stopwatch hour signal generating circuit 15, it produces a one-shot stopwatch 10-hour signal P52. That is to say, when the stopwatch measuring time comes to the stopwatch 10 hours in one second after 9 hours 59 minutes 59 seconds, the stopwatch 10-hour signal P52 controls the timing for returning the display to 0 hours 0 minutes 0 seconds and thus returning the stopwatch measuring time to the less than 60 minute mode. In the D-FF 53, an input terminal D is connected to a terminal Vdd, an input terminal T receives the stopwatch 60-minute signal P51, an input terminal R receives the stopwatch 10-hour signal P52, and from an output terminal Q, a mode switching signal P5 is produced.

More specifically, during the time between stopwatch start and 60 minutes of the stopwatch measuring time, neither the stopwatch 60-minute signal P51 nor the stopwatch 10-hour signal P52 is produced, and the mode switching signal P5 is at the "L" level, which is an initial level. When the stopwatch measuring time comes to 60 minutes, the stopwatch 60-minute signal P51 is produced, the D-FF 53 reads in the "H" level, and the mode switching signal P5 is switched from the "L" level to the "H" level. Then every 60 minutes, the stopwatch 60-minute signal P51 is produced. However, the mode switching signal P5 remains at the "H" level until the stopwatch counting time becomes 10 hours. Then, when the stopwatch counting time attains to 10 hours, the stopwatch 10-hour signal P52 and the stopwatch 60-minute signal P51 are produced at the same time, but in the D-FF 53, because of its rising operation, a resetting is always ahead, and the mode switching signal P5 is switched from the "H" level to the "L" level. Thereafter, the mode switching signal P5 repeats this operation.

Reference numeral 7 denotes a selector. When the input to a terminal C is at the "L" level, an input A is outputted from a terminal Q, and when the input to the terminal C is at the "H" level, an input B is outputted from the terminal Q. An input terminal A of the selector 7 receives the stopwatch 1/10-second pulse P14 from the stopwatch 1/10-second signal generating circuit 14, an input terminal B receives the stopwatch hour pulse P15 from the stopwatch hour signal generating circuit 15, and the control terminal C is controlled by the mode switching signal P5 of the mode control circuit 5. In the less than 60 minute mode of the stopwatch measuring time, the stopwatch 1/10-second pulse P14 is produced, and in the 60 minute or more mode, the stopwatch hour pulse P15 is produced.

A fourth drive circuit 19 produces a common driving signal P19 for driving both the stopwatch 1/10-second and the stopwatch hour in response to output signal of the selector 7. The common driving signal P19 is applied to a fourth motor 24 for driving the switchover hand 96 which interlocks with the fourth motor 24.

A mode signal generating circuit 6 receives the fifth signal of the stopwatch frequency division signal group P3 from the stopwatch frequency dividing circuit 3 and the mode switching signal P5 from the mode control circuit 5 and outputs a mode pulse P6 for a mode display pursuant to rising or falling timing of the mode switching signal P5. In other words, whenever the mode is changed, the mode pulse P6 is outputted.

A fifth drive circuit 20 produces a mode display driving signal P20 in response to the mode pulse P6. The mode display driving signal P20 is applied to a fifth motor 25 to drive the mode hand 97 which interlocks with the fifth motor 25 for mode display.

Next, the operation of the electronic hand display watch having the above structure will be described. The circuit of the usual time system of the hour hand 91, the minute hand 92 and the second hand 93 attached in the center of the dial 900 always operate to display the usual time. As for the stopwatch function, in the stopwatch stop state, since the switching signal P4 from the switching circuit 4 is at the "L" level, the frequency enabling signal P32 is at the "H" level, and therefore, the stopwatch frequency dividing circuit 3 does not perform the frequency dividing operation, and the stopwatch frequency division signal P3 is not produced. Thus, the stopwatch system circuit does not operate. As a result, the stopwatch second hand 94, the stopwatch minute hand 95, the switchover hand 96 and the mode hand 97 remain stopped. When the stopwatch start operation is initiated by means of external control member, the switching signal P4 is changed from the "L" level to the "H" level, the D-FF 32 is reset, and the stopwatch frequency division signal P32 is changed from the "H" level to the "L" level. The stopwatch frequency dividing circuit 3 starts the frequency dividing operation to produce the stopwatch frequency division signal group P3. In response to the stopwatch frequency division signal group P3, the stopwatch second signal generating circuit 12, the stopwatch minute signal generating circuit 13, the stopwatch 1/10-second signal generating circuit 14 and the stopwatch hour signal generating circuit 15 operate. In the less than 60 minute mode of the stopwatch measuring time, the mode switching signal P5 is at the "L" level, the stopwatch 1/10-second pulse P14 in the selector 7, is selected and produced, the switchover hand 96 is driven at 10 Hz in response to the stopwatch 1/10-second pulse P14, and indicates the 1/10-second display, and the stopwatch minute hand 95, the stopwatch second hand 94 and the switchover hand 96 display the stopwatch minute, second and 1/10 second. Also, in this mode, the mode hand 97 points to "1/10 SEC" to indicate that the switchover hand 96 shows 1/10 seconds. When the stopwatch measuring time comes to 60 minutes, the mode switching signal P5 of the mode control circuit 5 is changed from the "L" level to the "H" level, and in a moment of time, the mode pulse P6 is outputted from the mode signal generating circuit 6, and the mode hand 97 is driven accordingly to indicate "HOUR" message.

On the other hand, in the selector 7, by the mode switching signal P5 at the "H" level, the stopwatch hour pulse P15 has been selected and produced. In response to the stopwatch hour pulse P15, the switchover hand 96 is driven at an interval of one hour and shows the stopwatch hour. The stopwatch minute hand 95, the stopwatch second hand 94 and the switchover hand 96 show the stopwatch hour, minute and second, respectively. Also in the mode for 60 minutes or more of the stopwatch measuring time, the mode hand 97 points to "HOUR" to indicate that the switchover hand 96 shows the stopwatch hour.

When the stopwatch measuring time advances and comes to 10 hours, the mode switching signal P5 returns from the "H" level to the "L" level. In a moment of time, from the mode signal generating circuit 6, the mode pulse P6 is outputted, and the mode hand 97 is driven accordingly and points to "1/10 SEC". That is, the stopwatch measuring time returns to the less than 60 minute mode, the switchover hand 96 returns to the stopwatch 1/10-second again, and the stopwatch minute hand 95, the stopwatch second hand 94 and switchover hand 96 show the stopwatch minute, second and 1/10 second. Also, in either mode, the external control member permits the stopwatch stop operation, which causes the switching signal P4 to change from the "H" level to the "L" level, and by the timing of the 16 Hz frequency division signal P34, the D-FF 32 changes to the "H" level. Thus, in the absence of the driving signal, the stopwatch frequency dividing circuit 3 stops the frequency dividing operation, and the stopwatch hand stops accordingly. Therefore, the measured stopwatch time can be read.

As mentioned above, in the conventional electronic hand display watch, the graduations 90 indicated by the switchover hand 96 for changeably displaying the two functions of the stopwatch 1/10-second function and the stopwatch hour function are used in common to the stopwatch 1/10-second and the stopwatch hour. Therefore, the user cannot tell only by the switchover hand 96 whether he or she should read the numerals 98 for the stopwatch 1/10-second or the numerals 99 for the stopwatch hour. However, the mode hand 97 can show the user how to read the numerals for graduations 90 indicated by the switchover hand 96; In other words, when the mode hand 97 points to "1/10 SEC" in the mode for less than 60 minutes of the stopwatch measuring time, the user reads the numerals 98 for the stopwatch 1/10-second. When the mode hand 97 points to "HOUR" in the mode for 60 minutes or more of the stopwatch measuring time, the user reads the numerals 99 for the stopwatch hour.

Thus, in the conventional electronic hand display watch, the graduations 90 and the stopwatch 1/10-second numerals and the stopwatch-hour numerals 99 to be indicated by the switchover hand 96 for switching two functions occupy the same positions. Therefore, without reading the mode hand 97 which is a reading discrimination display means, the user cannot determine whether he should read the numerals 98 for the stopwatch 1/10-second or the numerals 99 for the stopwatch-hour. However, since the prices of watches are decreased in the recent market, even multifunction watches are suffering from a severe cost-down competition and their cost-down is necessary, and there is a big problem of cost-up caused by the mode hand 97, which is merely a display means for reading discrimination, and its driving control.

Also, in other type of hand display instruments, the cost of a hand display tester is raised because of its range control for indicating modes as reading discrimination display means.

DISCLOSURE OF THE INVENTION

The object of the present invention is to solve the above described problems and to provide a hand display device which has a hand for changeably displaying two functions and is low in cost and good in visibility. In order to accomplish the object, a single hand is employed so that within a movable region of the hand (that is, a range of a rotary angle of the hand in which such information as physical quantities is indicated by a stop position of the hand), various types of systematic graduations or symbols representing a pluralty of information are arranged so as not to essentially coincide (for example, the graduations or symbols are elements composing plural types of systems, and the respective elements are organized in a specific order such as magnitude of amount in the systematic information to which the respective elements belong, and the respective elements belonging to their systems are arranged alternately). The feature of the present invention is that the hand display device is provided with a drive control circuit for a pulse motor which interlocks with the hand so that the user can determine to which system the information pointed by the hand belongs and what amount or order is indicated in the information of the system by observing the stop position of the hand.

BEST MODE FOR CARRYING OUT THE INVENTION

Figure 1:
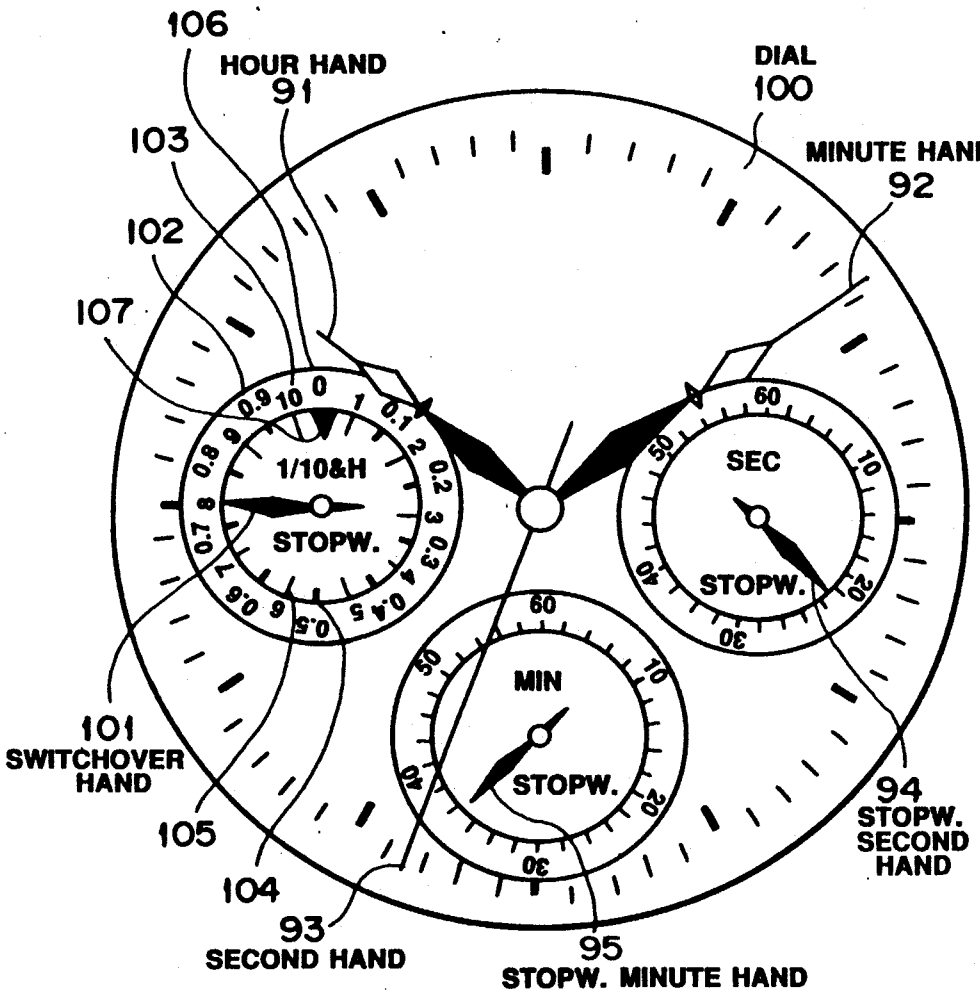
FIG. 1 is a plan view of a dial and hands of an electronic hand display watch with a stopwatch function according to a first embodiment of the present invention.
Figure 2:
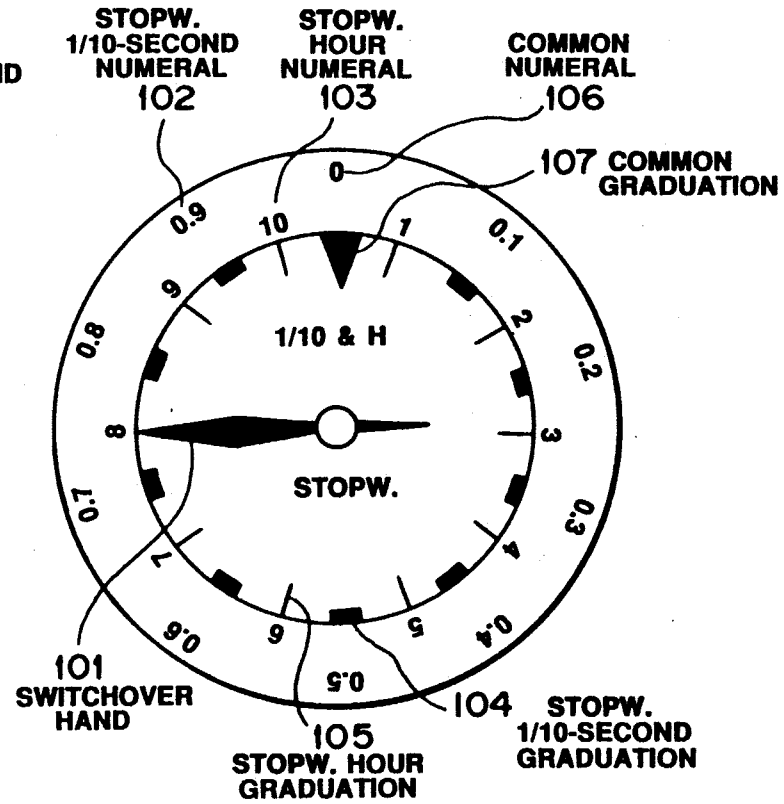
FIG. 2 is a partially enlarged plan view of FIG. 1.

The present invention will be described in detail with reference to the respective embodiments shown in the attached drawings: First Embodiment This embodiment provides an electronic hand display watch with stopwatch functions. The display surface has an external appearance as shown in FIG. 1, and the watch has a function as shown in FIG. 2. One of the hands selectively shows either the fractions of seconds in the measurement of time interval or the number of hours when the measuring time lasts several hours (hereinafter "stopwatch" is referred to as "stopw."). That is to say, this embodiment provides an electronic hand display watch with stopw. functions for displaying the stopw. 1/10-second, stopw. second, stopw. minute and stopw. hour. For each of the stopw. second and stopw. minute, a stopw. second hand and a stopw. minute hand are provided: however, for the two functions of the stopw. 1/10-second and the stopw. hour, a single hand is used. The hand is designed so that in the mode for less than 60 minutes of the stopw. measuring time, the stopw. 1/10-second is displayed and in the 60 minute or more more of the stopw. measuring time, the stopw. hour is displayed. When it is one second after 9 hours 59 minutes 59 seconds of the stopw. measuring time, the display returns to 0 hours 0 minutes 0 seconds, and the hand returns to the stopw. 1/10-second display (these specifications are common to those of the above mentioned conventional example).

Description of the Mechanical Section of the First Embodiment

FIG. 1 illustrates a dial 100 and hands which form the face of the electronic hand display watch of the present invention, and FIG. 2 is a partially enlarged view of the dial 100 of FIG. 1. On the dial 100, an hour hand 91, a minute hand 92, and a second hand 93 for displaying usual time are provided in the center of the dial, and around them, as smaller hands, a stopw. second hand 94 for displaying the stopw. second, a stopw. minute hand 95 for displaying the stopw. minute and a switchover hand 101 for displaying the stopw. 1/10 second and the stopw. hour are provided. At the outermost periphery of the dial 100 to which the switchover hand 101 is attached, as enlargedly shown in FIG. 2, stopw. 1/10-second numerals 102 necessary to read the stopw. 1/10-second are arranged; at its inside, stopw. hour numerals 103 necessary to read the stopw. hour are arranged; and in the innermost section, stopw. 1/10-second graduations 104 are arranged corresponding to the positions of the stopw. 1/10 second numerals 102, and also stopw. hour graduations 105 for the stopw. hour arranged correspoding to the postions of the stopw. hour numerals 103. Furthermore, a common numeral 106 which is "0" and commonly used for the stopw. 1/10-second function and stopw. hour function is provided. A common graduation 107 for the common numeral 106 is arranged corresponding to the common numeral 106.

The stopw. 1/10-second graduations 104 and the stopw. 1/10-second numerals 102 for the stopw. 1/10-second of the first function, and the stopw. hour graduations 105 and the stopw. hour numerals 103 for the stopw. hour of the second function are arranged so that any of the respective graduations or numerals does not occupy the same angular position except for the common reference or origin.

Figure 3:
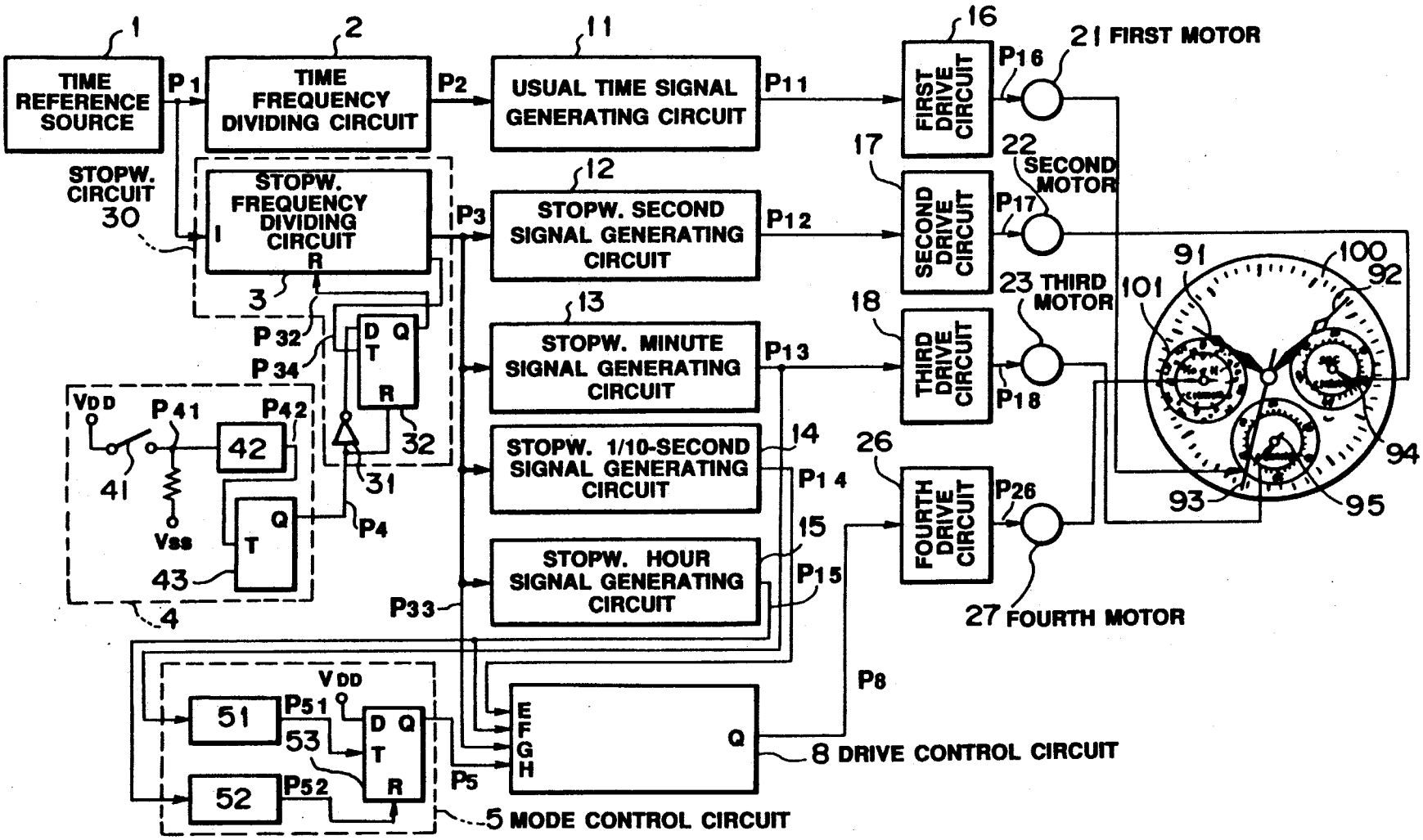
FIG. 3 is a circuit block diagram of the first embodiment.
Figure 11:
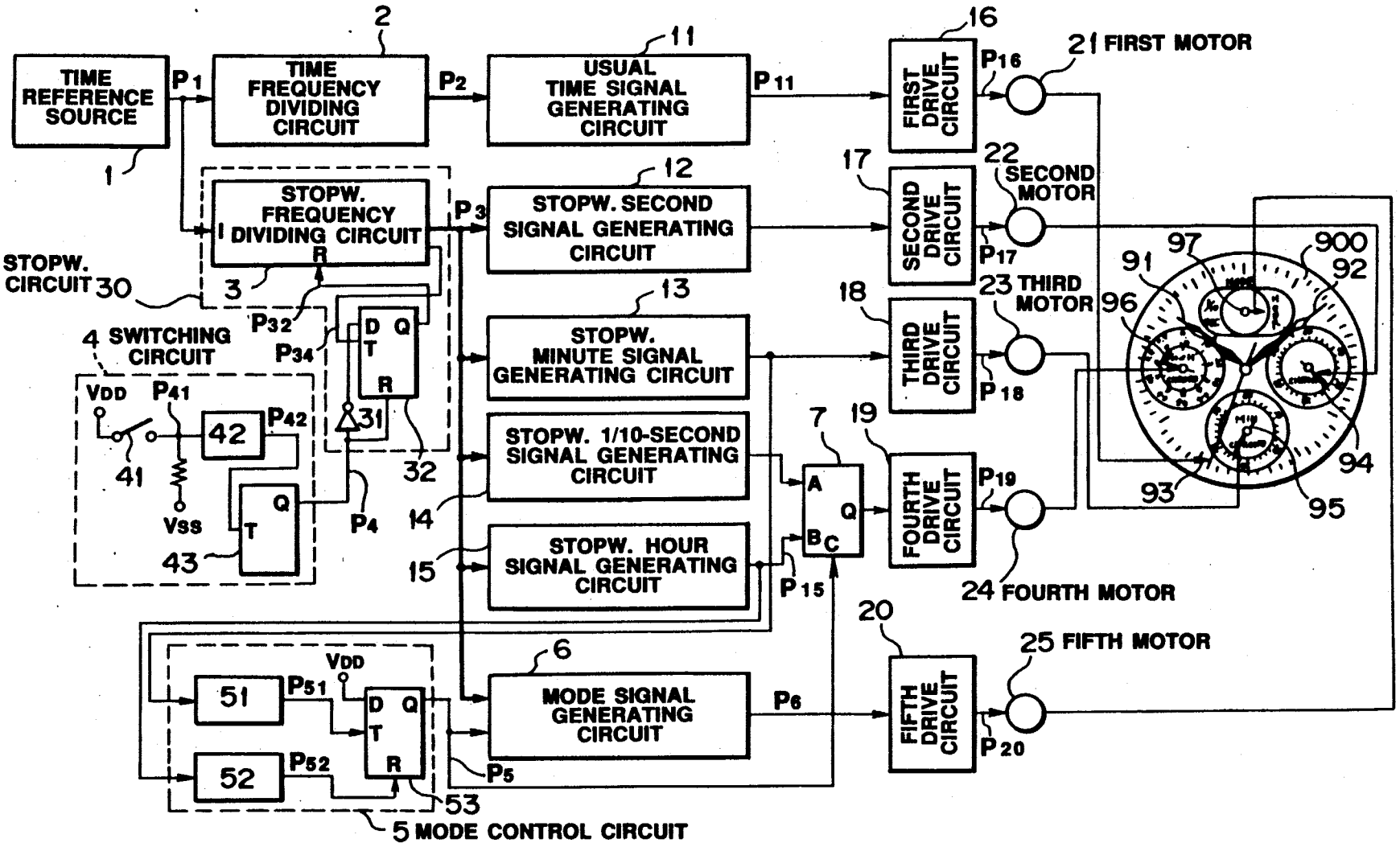
FIG. 11 is a block diagram of the circuit of the above conventional example.

Description of the Structure and Function of the Circuit Section of the First Embodiment FIG. 3 is a block diagram of the circuit of an electronic hand display watch according to the present invention. A dial 100 and a switchover hand 101 are identical with those of FIG. 1, and the explanation will be omitted. Also, in FIG. 3, the same elements as in FIG. 11 of the circuit block diagram of the conventional electronic hand display watch are given the same reference numerals, and the explanation will be omitted. Now, in FIG. 3, the elements different from those of FIG. 11 will be explained.

A drive control circuit 8 includes an input terminal G which receives a 128 Hz frequency division signal P33 which is a part of a stopw. frequency division signal group P3, from a stopw. frequency dividing circuit 3, an input terminal E which receives a stopw. 1/10-second pulse P14 from a stopw. 1/10-second signal generating circuit 14, an input terminal F which receives a stopw. hour pulse P15 from a stopw. hour signal generating circuit 15, and an input terminal H which receives a mode switching signal P5 from a mode control circuit 5. Under the control of the mode switching signal P5 supplied to the input terminal H, when one of the functions is selected, drive control signals P8 at unequal intervals are outputted from an output terminal Q so that the switchover hand 101 does not remain stopped for a long time in the position of any graduation or numeral corresponding to other function.

A fourth drive circuit 26 produces driving signals P26 for the stopw. 1/10-second and stopw. hour in response to the drive control signal P8. The driving signals P26 is sent to a fourth motor 27 to drive the switchover hand 101 which interlocks with the fourth motor 27.

Figure 4:
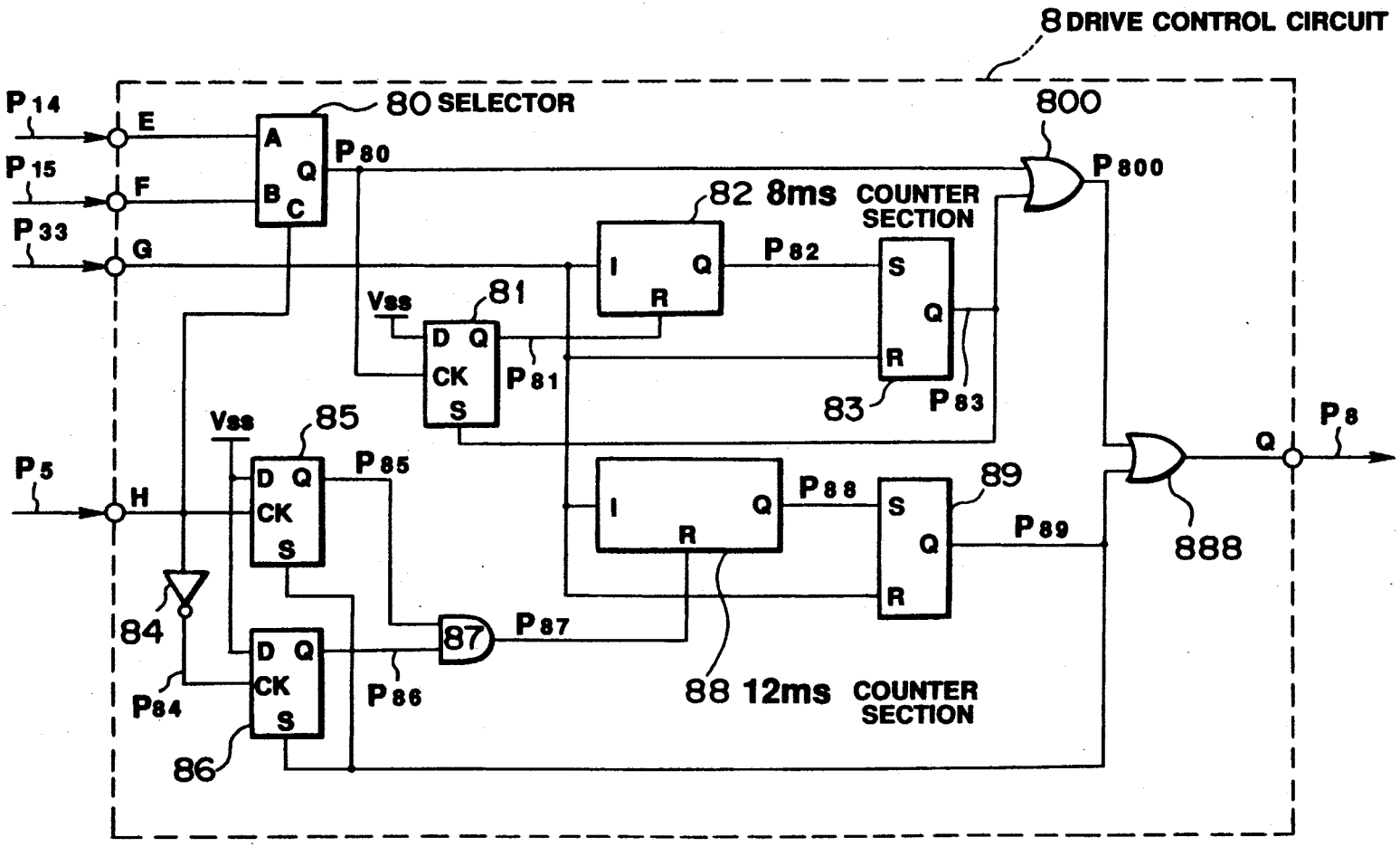
FIG. 4 is a partially detailed view of FIG. 3.

Next, the structure of the drive control circuit 8 will be described in more detail with reference to FIG. 4.

The drive control circuit 8 includes a selector 80; set-provided data type flip-flops 81, 85 and 86 (SD-FFS); set reset type latches 83 and 89 (SR-latches); an inverter 84 (INV); and AND 87; ORS 800 and 888; an 8 ms counter section 82 and a 12 ms count section 88.

The selector 80 produces the signal inputted to the input terminal A from its terminal Q when the input applied to a terminal C is at the "L" level and produces the signal inputted to the input terminal B from the terminal Q when the input applied to the terminal C is at the "H" level. The input terminal A of the selector 80 is connected to the input terminal E and receives the stopw. 1/10-second pulse P14 from the stopw. 1/10-second signal generating circuit 14. The input terminal B of the selector 80 is connected to the input terminal F and receives the stopw. hour pulse P15 from the stopw. hour signal generating circuit 15.

An input terminal C of the selector 80 is connected to the input terminal H, and in response to the mode switching signal P5 from the mode control circuit 5, the stopw. 1/10-second time pulse P14 is outputted when the stopw. measuring time is in the less than 60 minute mode, and the stopw. hour pulse P15 is outputted in the 60 minute or more mode as a selector signal P80 from the output terminal Q of the selector 80.

An input terminal S, which is a setting input terminal, of the SD-FF 81 receives a position correction pulse P83 from the SR-latch 83 (discussed later) and an input terminal CK receives the selector signal P80. An input terminal D of the SD-FF 81 is connected to a power source terminal Vss and is always kept at the "L" level. By a rising operation of the selector signal P80 applied to the input terminal CK, the SD-FF 81 reads in the data at the input terminal D (in this case, the "L" level of the power source terminal Vss is read in), applies an 8 ms count enable signal P81 at the "L" level to an output terminal Q, and then by the output timing of the position correction pulse P83 applied to the input terminal S, the 8 ms count enable signal P81 is changed from the "L" level to the "H" level.

An input terminal I of the 8 ms counter section 82 is connected to the input terminal G and receives the 128 Hz frequency division signal P33 of the stopw. frequency division signal group P3 from the stopw. frequency dividing circuit 3, and an input terminal R receives the 8 ms count enable signal P81. When the 8 ms count enable signal P81 applied to the input terminal R becomes the "L" level, the 8 ms counter section 82 performs counting operation by the falling timing of the 128 Hz frequency division signal P33 applied to the input terminal I. When counting 8 ms, the 8 ms counter section 82 outputs an 8 ms count signal P82 at the "H" level from its output terminal Q.

The SR-latch 83 is a set-reset type latch. By the signal applied to an input terminal S which is a setting input terminal, an output terminal Q becomes the "H" level, and by the signal applied to an input terminal R which is a reset input terminal, the output terminal Q becomes the "L" level. Since the input terminal S of the SR-latch 83 receives the 8 ms count signal P82 and the input terminal R is connected to the input terminal G, the SR latch 83 receives the 128 Hz frequency division signal P33 of the stopw. frequency division signal group P3. When one of the functions is selected, the SR-latch 83 outputs a position correction pulse P83 to prevent the switchover hand 101 from staying at the position of any graduation or numeral corresponding to the other function for a longer time than at the position of any graduation or numeral corresponding to one function.

The OR 800 receives the selector signal P80 at one of the input terminals and the position correction pulse P83 at the other input terminal so that it outputs an unequal interval pulse P800 from its output terminal.

The input terminal of the INV 84 is connected to the input terminal H. The INV 84 receives the mode switching signal P5 from the mode control circuit 5 and outputs an inverted mode switching signal P84 from its output terminal.

An input terminal S, which is a setting input terminal, of the SD-FF 85 receives a mode switching correction pulse P89 of the SR-latch 89 (discussed later). Since an input terminal CK of the SD-FF 85 is connected to the input terminal H, the SD-FF 85 receives the mode switching signal P5 from the mode control circuit 5. An input terminal D of the SD-FF 85 is connected to a power source terminal Vss; therefore, it is always kept at the "L" level. At the moment of the rising operation of the mode switching signal P5 applied to the input terminal CK, that is, at the moment that the mode function is changed from the less than 60 minute mode of the stopw. measuring time (stopw. 1/10-second function) to the mode for 60 minutes or more (stopw. hour function), data at the input terminal D (in this case "L" level of the power source terminal Vss) are read in, and a 60 minute or more shift signal P85 at the "L" level is applied to its output terminal Q. Then, by the output timing of the mode switching correction pulse P89 applied to the input terminal S, the 60 minutes or more shift signal P85 is changed from the "L" level to the "H" level.

An input terminal S, which is a setting input terminal, of the SD-FF 86 receives the mode switching correction pulse P89 from the SR-latch 89 (discussed later), and an input terminal CK receives the inverted mode switching signal P84. An input terminal D of the SD-FF 86 is connected to the power source terminal Vss and always at the "L" level. At the moment of the rising operation of the inverted mode switching signal P84 at the input terminal CK, that is, at the moment that the mode function is changed from the 60 minute or more mode (stopw. hour function) to the less than 60 minute mode (stopw. 1/10-second function), data at the input terminal D (in this case, "L" level of the power source terminal Vss) are read in, and a less than 60 minute shift signal P86 at the "L" level is produced to an output terminal Q. Then, by the output timing of the mode switching correction pulse P89 applied to the input terminal S, the less than 60 minutes shift signal P86 is changed from the "L" level to the "H" level.

The AND 87 receives the 60 minute or more shift signal P85 at one of the input terminals and the less than 60 minute shift signal P86 at the other input terminal. When either the 60 minute or more shift signal P85 or the less than 60 minute shift signal P86 is at the "L" level, a 12 ms count enable signal P87 at the "L" level is outputted from an output terminal of the AND 87, and then by the output timing of the mode switching correction pulse P89 from the SR latch 89 (discussed later), the 12 ms count enable signal P87 is changed from the "L" level to the "H" level.

An input terminal I of the 12 ms counter section 88 is connected to the input terminal G and receives a 128 Hz frequency division signals P33 of the stopw. frequency division signal group P3 from the stopw. frequency dividing circuit 3. An input terminal R of the 12 ms counter section 88 receives the 12 ms count enable signal P87. When the 12 ms enable signal P87 applied to the input terminal R becomes the "L" level, the 12 ms counter section 88 starts counting from this point in accordance with the falling timing of the 128 Hz frequency division signal P33 applied to the input terminal I. When it counts 12 ms, the 12 ms counter section outputs a 12 ms count signal P88 at the "H" level from its output terminal Q.

The SR-latch 89 is a set reset type latch. When a signal is applied to an input terminal S which is a setting input terminal, its output terminal Q becomes the "H" level. When a signal is applied to an input terminal R which is a resetting input terminal, the output terminal Q becomes the "L" level. The SR-latch 89 receives the 12 ms count signal P88 at the input terminal S. Since the other input terminal R is connected to the input terminal G, the terminal R receives the 128 Hz frequency division signal P33 of the stopw. frequency division signal group P3 from the stopw. frequency dividing circuit 3. When one mode is switched over to the other mode, the mode switching correction pulse P89 is produced from the output terminal Q so as to shift the switchover hand 101 to the displaced position in which graduations or numerals corresponding to the other function mode are marked.

The OR 88 receives the unequal interval pulse P800 at one of the input terminals and the mode switching correction pulse P89 at the other input terminal. From its output terminal, the OR 888 outputs a drive control signal P8 which prevents the switchover hand 101 from staying for a long time at the positon of any graduation or numeral corresponding to the other function when one of the function is selected. The signal P8 also shifts the switchover hand 101 to the position of any graduation or numeral corresponding to the other function when one function is changed to the other function. The drive control signal P8 is outputted from the drive control circuit 8 through the output terminal Q.

Description of the Operation of the Circuit Section of the First Embodiment

Operation of the electronic hand display watch having the above described structure shown in FIGS. 3 and 4 will be described with reference to the main voltage waveform charts of FIGS. 5 to 8. A description of the identical parts to those of the conventional structure of FIG. 11 will be omitted.

Figure 5:
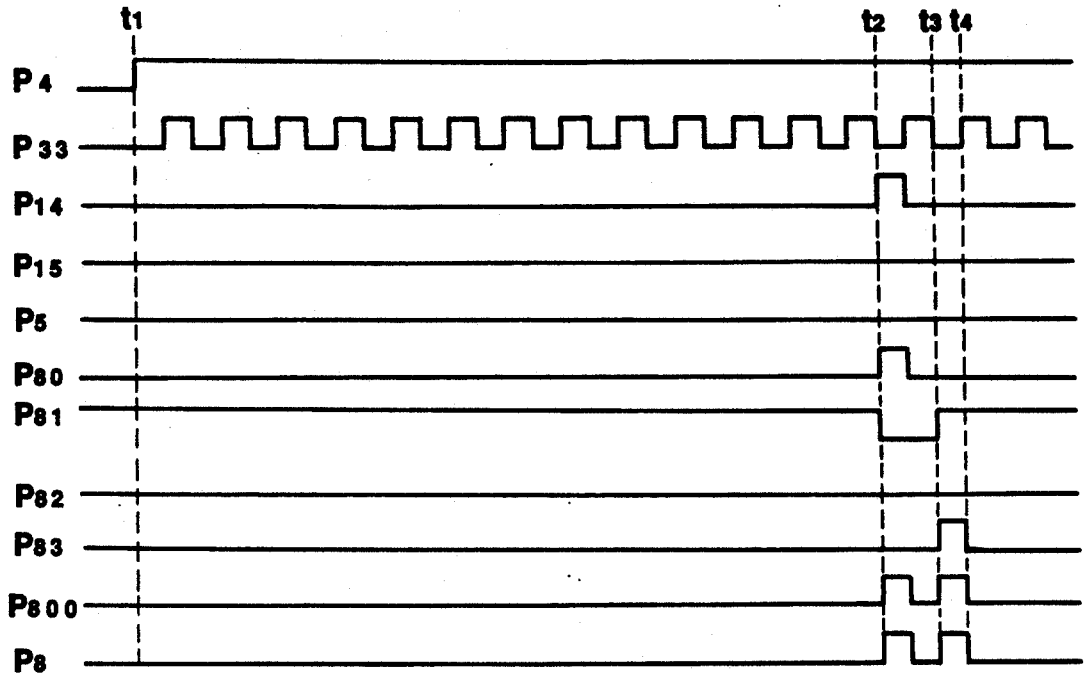
FIG. 5 to FIG. 8 are timing charts of operations of main signals.

FIG. 5 is a main voltage waveform chart showing the stopw. measuring time in the less than 60 minute mode just after the stopwatch is started from the zero stop state. This operation will be described.

First of all, the timing t1 will be explained. When the stopwatch is started by means of external control member, the switching signal P4 is changed from the "L" level to the "H" level, and the stopw. frequency dividing circuit 3 starts the frequency dividing operation, outputting the 128 Hz frequency division signal P33.

Next, the timing t2 will be explained. The stopw. frequency dividing circuit 3 performs the frequency dividing group P3, the stopw. secoond signal generating circuit 12, the operation, and under the stopw. frequency division signal stopw. minute signal generating circuit 13, the stopw. 1/10-second generating circuit 14 and the stopw. hour signal generating circuit 15 are operated. By the timing t2, the stopw. 1/10-second pulse P14 is produced. Since the stopw. measuring time is in the less than 60 minute mode, the mode switching signal P5 is at the "L" level, and the selector 80 selectively produces the stopw. 1/10-second pulse P14 as the selector signal P80, which is supplied via OR 800 and OR 888, as the drive control signal P8. Also by the rising operation of the selector signal P80, the SD-FF 81 reads in the "L" level and outputs the 8 ms count enable signal P81 at the "L" level.

The timing t3 will be explained. By the timing t3 which counts 8 ms after the timing t2 in which the 8 ms count enable signal P81 has become the "L" level, the 8 ms count enable signal P82 at the "H" level is produced. Under the 8 ms count signal P82, the SR latch 83 is set, and the position correction pulse P83 becomes the "H" level. Under the position correction pulse P83, the SD-FF 81 is set, the 8 ms count enable signal P81 is changed from the "L" level to the "H" level, and accordingly the 8 ms count section 82 is reset. The 8 ms count signal P82, which has risen by the timing at a moment before, becomes the "L" level again, and eventually, the 8 ms count signal P82 becomes a whisker signal.

Next, the timing t4 will be explained. After the timing t3 in which the position correction pulse P83 has become the "H" level, the 128 Hz pulse P83 first becomes the "L" level. Then, the SR-latch 83 is reset, and the position correction pulse P83 is changed from the "H" level to the "L" level.

More specifically, the position correction pulse P83 is a 4 ms upward pulse between the timing t3 and the timing t4, and this pulse is produced via OR 800 and OR 888 as the drive control signal P8.

The motion of the switchover hand 101 under the drive control signal P8 in the main voltage waveform chart of FIG. 5 will be described with reference to FIG. 2 which illustrates the graduations and numerals. First, until the timing t1, the stopw. measuring time is in the zero stop state, and the switchover hand 101 points to position "0" of the common numeral 106.

Next, under the drive control signal P8 produced by the timing t2, the switchover hand 101 is shifted to numeral "1" of the stopw. hour numerals 103, but under the drive control signal P8 produces immediately after the timing t3, the switchover hand 101 is shifted to numeral "0.1" of the stopw. 1/10-second numerals 102. There is only 8 ms between the timing t2 to the timing t3, and the switchover hand 101 rests at position "1" of the stopw. hour numeral only for 8 ms. To human eyes, therefore, it looks as if the switchover hand 101 shifted at a time from "0" of the common numeral 106 to "0.1" of the stopw. 1/10-second numeral 102. Also, after the main voltage waveform chart of FIG. 5, the same operation is conducted as above, as far as the less than 60 minute mode of the stopw. measuring time continues. In accordance with the output timing of the stopw. 1/10-second pulse P14, it looks to human eyes as if the switchover hand 101 shifted positions "0.1", "0.2", "0.3" . . . "0.9" of the stopw. 1/10-second numerals 102.

Figure 6:
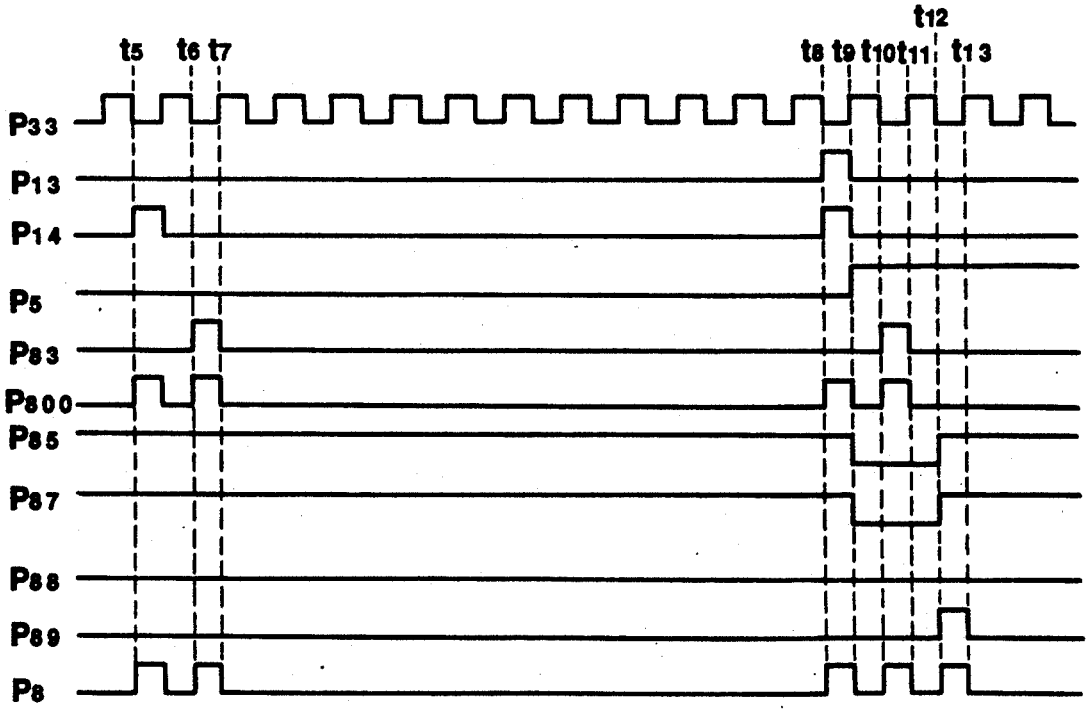

FIG. 6 is a main voltage waveform chart showing that the stopw. measuring time is changed from 59 minutes 59 seconds 9 to 1 hour 00 minutes 00 seconds, that is, the stopw. measuring time is changed from the less than 60 minute mode to the 60 minute or more mode. This operation will be described below.

The operations in the timings t5, t6 and t7 are the same as those of t2, t3 and t4, and therefore, the explanation will be omitted. Also, the operations in the timings t8, t10 and t11 are the same as those of t2, t3 and t4 of FIG. 5, and the explanation will be omitted.

Next, the timing t9 will be explained. Under the stopw. minute pulse P14, a base-60 count section 51 of the mode control circuit 5 detects that the stopw. count time comes to 60 minutes and produces a stopw. 60 minute signal P51. Under the stopw. 60 minute signal P51, the D-FF 53 reads in the "H" level, and the mode switchover signal P5 is changed from the "L" level to the "H" level. Since the mode switchover signal P5 rises, the SD-FF 85 reads in the "L" level and produces the 60 minute or more shift signal P85 which is at the "L" level. Under the 60 minute or more shift signal P85, the AND 87 outputs the 12 ms count enable signal P87 which is at the "L" level.

The timing t12 will be explained below. By the timing t12 which counts 12 ms from the timing t2 by which the 12 ms count enable signal P87 has become the "L" level, the 12 ms count signal P88 which is at the "H" level is produced. Under the 12 ms count signal P88, the SR latch 89 is set, and the mode switching correction pulse P89 becomes the "H" level. Under the mode switching correction pulse P89, the SD-FF 85 performs a setting operation, and the 60 minute or more shift signal P85 and the 12 ms count enable signal P87 are changed from the "L" level to the "H" level. Accordingly the 12 ms count section 88 is set, and the 12 ms count signal P88 risen by the timing immediately before becomes the "L" level again. Thus, the 12 ms count signal P88 becomes a whisker signal.

The timing t13 will be discussed. Since the 128 Hz pulse P33 becomes the "H" level for the first time, after the timing 12 by which the mode switching correction pulse P89 has become the "H" level, the SR-latch 89 is reset, and the mode switching correction pulse P89 is changed from the "H" level to the "L" level.

More specifically, the mode switching correction pulse P88 is a 4 ms upward pulse between the timing t12 and the timing t13, and it is produced via the OR 888 as the drive control signal P8.

The motion of the switchover hand 101 under the drive control signal P8 in the main voltage waveform chart of FIG. 6 will be described with reference to FIG. 2 which illustrates the graduations and numerals. First, in the state immediately before the timing of t5, the stopw. measuring time is 59 minutes 59 seconds 8, and the switchover hand 101 points to position "0.8" among the stopw. 1/10-second numerals 102.

Under the drive control signal P8 outputted at the timing t5, the switchover hand 101 is shifted to "9"of the stopw. hour numerals, but under the drive control signal P8 outputted just after the timion t6, the switchover hand 101 is shifted to position "0.9" of the stopw. 1/10-second numeral 102. Since between the timing t5 and the timing t6 is only 8 ms, the switchover hand 101 rests at position "9" of the stopw. hour numeral 103 only for 8 ms, and it appears to human eyes as if the switchover hand 101 has shifted at a time from "0.8" to "0.9" of the stopw. 1/10-second numerals 102. Also, the stopw. measuring time advances to 59 minutes 59 seconds 9.

Similarly, under the drive control signal P8 outputted at the timings t8 and t10, the switchover hand 101 is shifted from "0.9" of the stopw. 1/10 second numeral 102 to "0" of the common numeral 106, and thus the stopw. measuring time advances to 60 minutes 00 seconds 0. Since the mode has changed to 60 minutes or more, the drive control signal P8 produced at the timing t12 shifts the switchover hand 101 from "0" of the common numeral 106 to "1" of the stopw. hour numeral. In other words, the switchover hand 101 is changed to the stopw. hour graduation 105 and the stopw. hour numeral 103 for the 60 minutes or more mode. The stopw. display becomes 1 hour 00 minutes 00 seconds.

Figure 7:
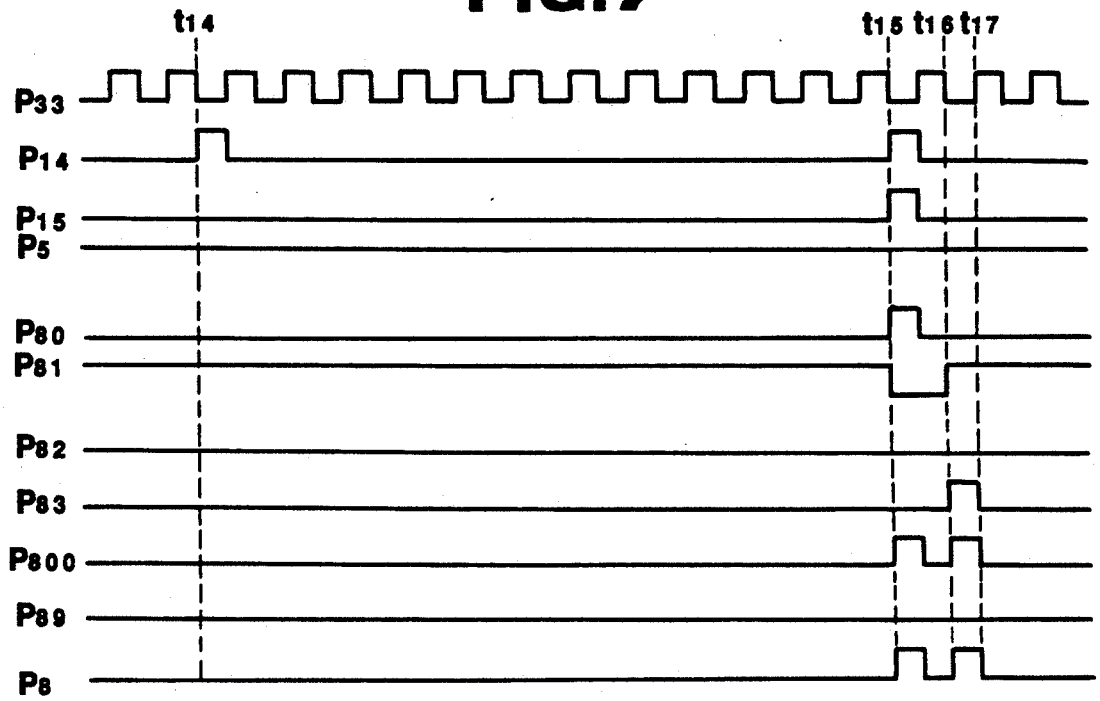

FIG. 7 is a main voltage waveform chart of the 60 minute or more mode when the stopw. measuring time is changed from 1 hour 59 minutes 59 seconds 9 to 2 hours 00 minutes 00 seconds 0. This operation will be described below.

First, the timing t14 will be explained. By the timing t14, the stopw. measuring time becomes 1 hour 59 minutes 59 seconds 9, and from the stopw. 1/10-second signal generating circuit 14, the stopw. 1/10-second pulse P14 is produced. This is in the 60 minute or more mode, and the mode switching signal P5 is at the "H" level. From the selector 80, no stopw. 1/10 pulse P14 is selectively produced as the selector signal P80, and accordingly, the drive control signal P8 remains at the "L" level.

Next, the timing t15 will be described. By the timing t15, the stopw. 1/10-second pulse P14 and the stopw. hour pulse P15 are produced. The mode switching signal P5 is at the "H" level, and from the selector 80, the stopw. hour pulse P15 is selectively produced as the selector signal P80, which is supplied via the OR 800 and the OR 888 as the drive control signal P8. By the rising operation of the selector signal P80, the SD-FF 81 reads in the "L" level and produces the 8 ms count enable signal P81 which is at the "L" level.

Since the timings t16 and t17 are the same in operation as the timings t3 and t4, the explanation will be omitted.

The motion of the switchover hand 101 under the drive control signal P8 in the main voltage waveform chart of FIG. 7 will be described with reference to FIG. 2 which illustrates the graduations and numerals. First, in the state immediately before the timing t14, the stopw. measuring time is 1 hour 59 minutes 59 seconds 8, and by the timing t14, it becomes 1 hour 59 minutes 59 seconds 9. However, no drive control signal P8 is produced; accordingly, the switchover hand 101 is not driven and remains pointing to "1" of the stopw. hour numerals 103.

Next, under the drive control signal P8 produced by the timing t15, the switchover hand 101 is shifted to "0.1" of the stopw. 1/10-second numerals 102, but under the drive control signal P8 produced immediately after timing t16, the switchover hand 101 is shifted to "2" of the stopw. hour numerals 103. Since between the timing t15 and the timing t16 is only 8 ms, and the switchover hand 101 rests at position "0.1" of the stopw. 1/10-second numeral 102 only for 8 ms, it looks to human eyes as if the switchover hand 101 has shifted from "1" to "2" of the stopw. hour numerals 103 at a time. The 60 minute or more mode of the stopw. measuring time after the main voltage waveform chart of FIG. 7 is the same as this, and in accordance with the output timing of the stopw. hour pulse P15, it looks to human eyes as if the switchover hand 101 was moving positions "2". "3", "4" . . . "9" of the stopw. hour numerals.

Figure 8:
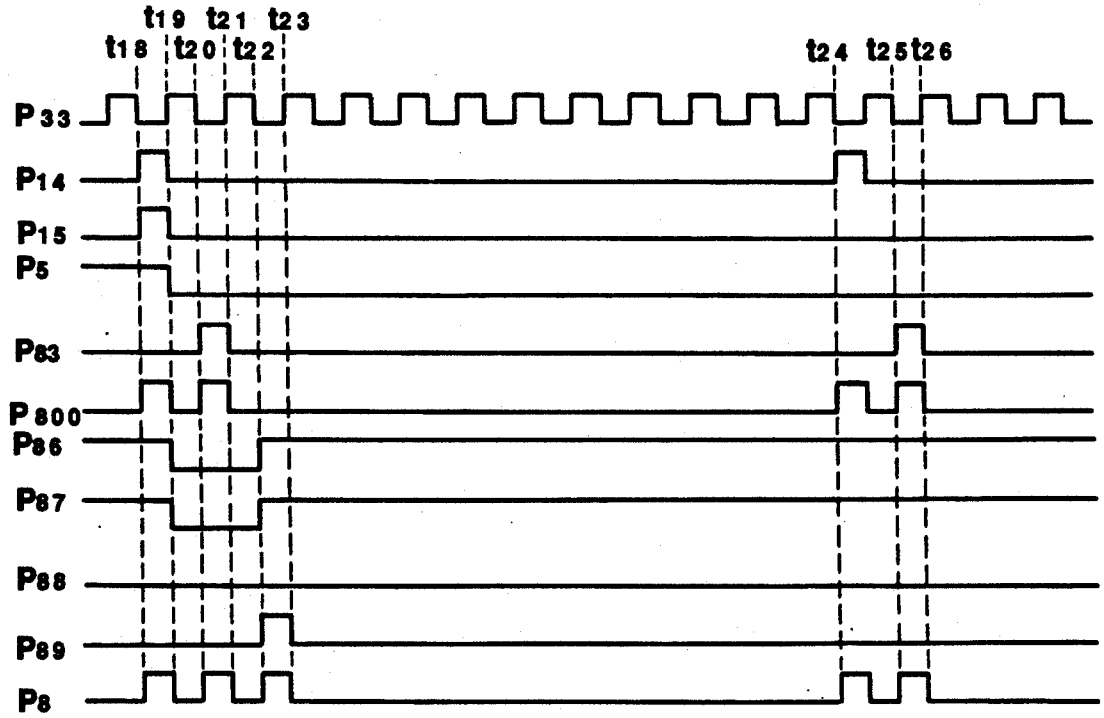
Figure 10:
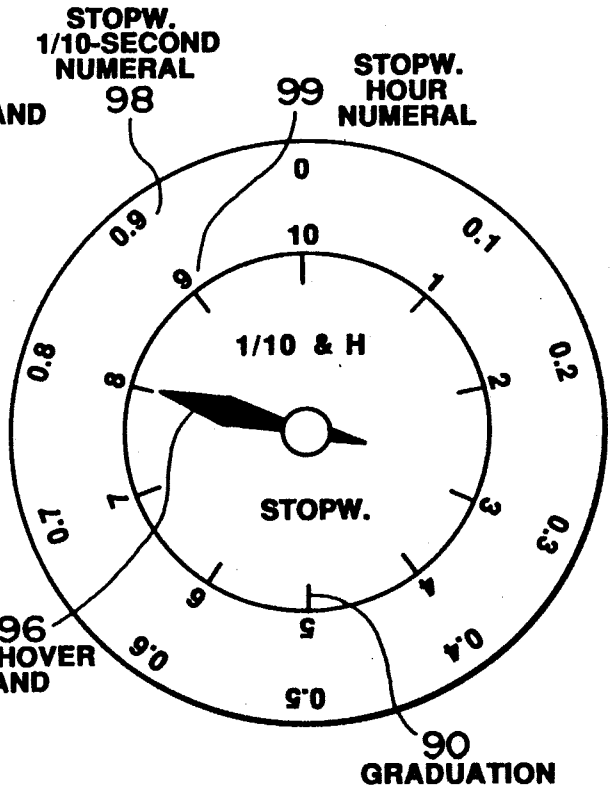
FIG. 10 is a partially enlarged plan view of FIG. 9.
Figure 9:
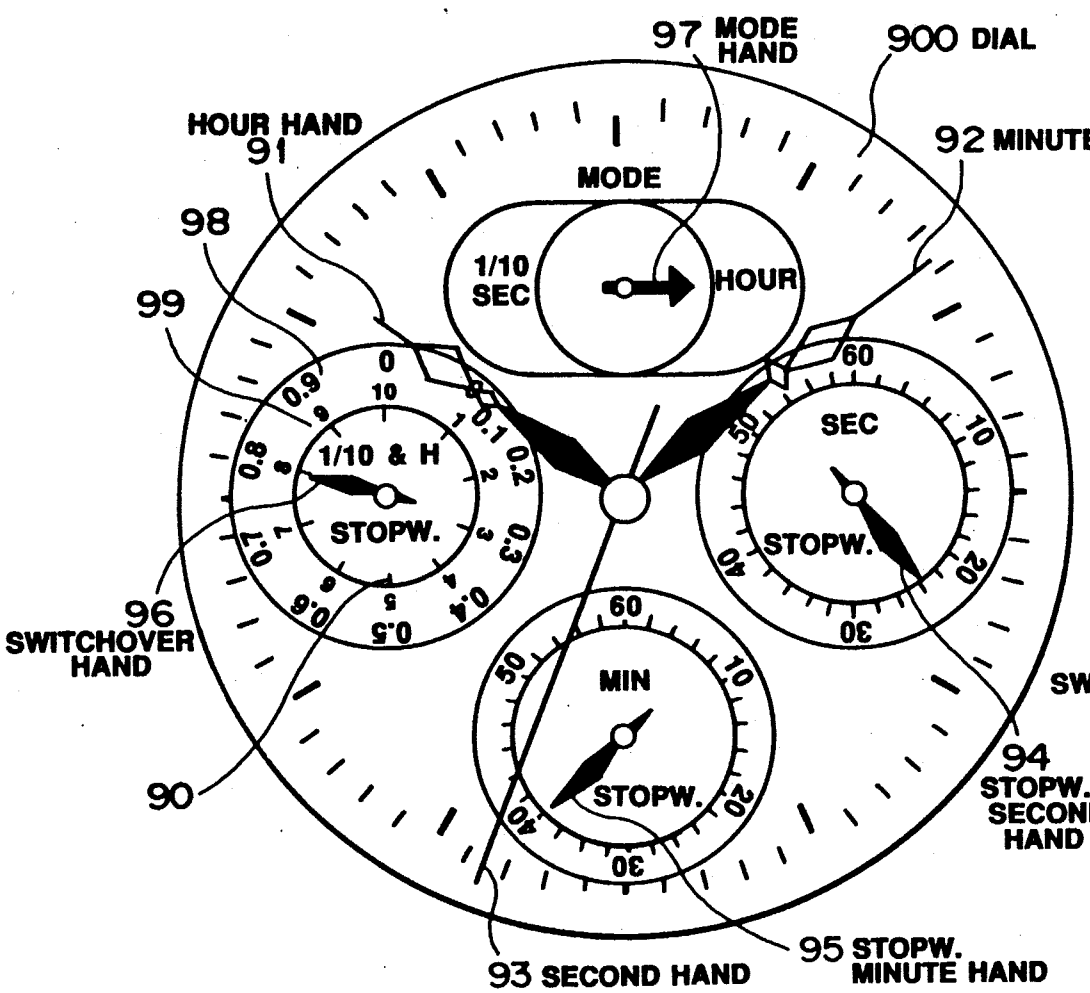
FIG. 9 is a plan view of a dial and hands of an electronic hand display watch which is an example of conventional electronic hand display devices.

FIG. 8 is a main voltage waveform chart in which the stopw. measuring time returns from 9 hours 59 minutes 59 seconds to 0 minutes 0 seconds 0 again in the next one second, that is, the stopw. measuring time is changed from the 60 minute or more mode to the less than 60 minute mode. This operation will be described below.

The timings t18, t20 and t21 are the same in operation as the timings t15, t16 and t17 of FIG. 7, and the explanation will be omitted.

The timing t19 will be discussed. Under the stopw. hour pulse p15, the base-10 count section 52 of the mode control circuit 5 detects that the stopw. count time comes to 10 hours and produces the stopw. 10-hour signal P52. Under the stopw. 10-hour signal P52, the D-FF 53 is reset, and the mode switching signal P5 is changed from the "H" level to the "L" level. Since the mode switching signal P5 falls down, the inverted mode switching signal P84 from the INV 84 rises. The SD-FF 86 reads in the "L" level and produces the signal P86 for shifting to the less than 60 minute mode and under the less than 60 minute shift signal P86, the AND 87 produces the 12 ms count enable signal P87 which is at the "L" level.

The timings t22 and t23 are the same in operation as the timings t12 and t13 in FIG. 6, and therefore, the explanation will be omitted.

The timings t24, t25 and t26 after the stopw. measuring time has shifted to the less than 60 minute mode are the same in operation as the timings t2, t3 and t4 in FIG. 5, and therefore, the explanation will be omitted.

The motion of the switchover hand 101 under the drive control signal P8 in the main voltage waveform chart of FIG. 8 will be explained with reference to FIG. 2 which illustrates graduations and numerals. First, in the state immediately before the timing t18, the stopw. measuring time is 9 hours 59 minutes 59 seconds, and the switchover hand 101 points to position "9" among the stopw. hour numerals 103.

Next, under the drive control signal P8 produced by the timing t18, the switchover hand 101 is shifted to "0.9" of the stopw. 1/10-second numerals. However, under the drive control signal P8 produced immediately after timing t20, the switchover hand 101 is shifted to "10" of the stopw. hour numerals 103. Between the timing t18 and the timing t20 is only 8 ms, the switchover hand 101 rests at position "0.9" of the stopw. 1/10-second numeral 102 only for 8 ms and is shifted from "9" to "10" of the stopw. hour numerals 103 at a time. Also, the stopw. measuring time advances to 10 hours 00 minutes 00 seconds. Now, returning to the less than 60 minute mode, under the drive control signal P8 produced by the timing t22, the switchover hand 101 is shifted from "10" of the stopw. hour numeral 103 to "0" of the common numeral 106.

Then, under the drive control signal P8 produced by the timings t24 and t26 after the stopw. measuring time is shifted to the less than 60 minute mode, it looks to human eyes as if the switchover hand 101 shifted from "0" of the common numeral 106 to "0.1" of the stopw. 1/10-second numeral instantaneously. That is to say, the switchover hand 101 is shifted to the stopw. 1/10-second numeral 102 for the less than 60 minute mode.

After the operation described with reference to FIG. 8, the operations shown in FIGS. 5 to 8 are repeated. In any mode, the external control member permits a stopwatch function stop operation. By this operation, the switching signal P4 is changed from the "H" level to the "L" level. By the timing of the 16 Hz frequency division signal P34, the D-FF 32 becomes the "H" level, and the stopw. frequency dividing circuit 3 stops the frequency dividing operation. Thus, after the position correction pulse P83 is produced, the stopwatch function stop is caused. Even if the stopwatch function is stopped in either mode, the switchover hand 101 stops at the common graduation or any of numerals for each mode, thus displaying correct stopwatch measured time.

Also, if the switchover hand 101 stops at position "0" of the common numeral 106 by stopwatch stop operation, the user cannot know if he or she should take the switchover hand 101 as the stopw. 1/10-second time function or the stopw. hour time function. But no such concern is necessary and there is no problem. Suppose that after the stopwatch stop operation, the stopw. minute hand 95 is at position of "7", the stopw. second hand 94 is at position of "28", and the switchover hand 101 is at position of "0", the actual measured time is just 0 hours, 7 minutes, 28 seconds, 0 tenths of a second, even though it is read as either 7 minutes, 28 seconds, 0 or 0 hours, 7 minutes, 28 seconds. Therefore, there is no problem even if the common numeral 106 which indicates numeral "0" and the common graduation 107 occupy the same position with two functions, and it is rather natural and preferable that the graduation or numeral "0" common to the stopw. 1/10 second time function and the stopw. hour time function occupy the same position. Second Embodiment In the first embodiment, the two functions are the same time measuring functions, but the measuring units are quite different. As will be described hereinafter, the second embodiment is a specific example wherein two functional displays, numerals of the different physical dimensions and of the same order are handled, and only the measuring origin for the respective functions (numeral zero point) is placed at the same position and used in common. This will be described with reference to FIG. 12.

Figure 12:
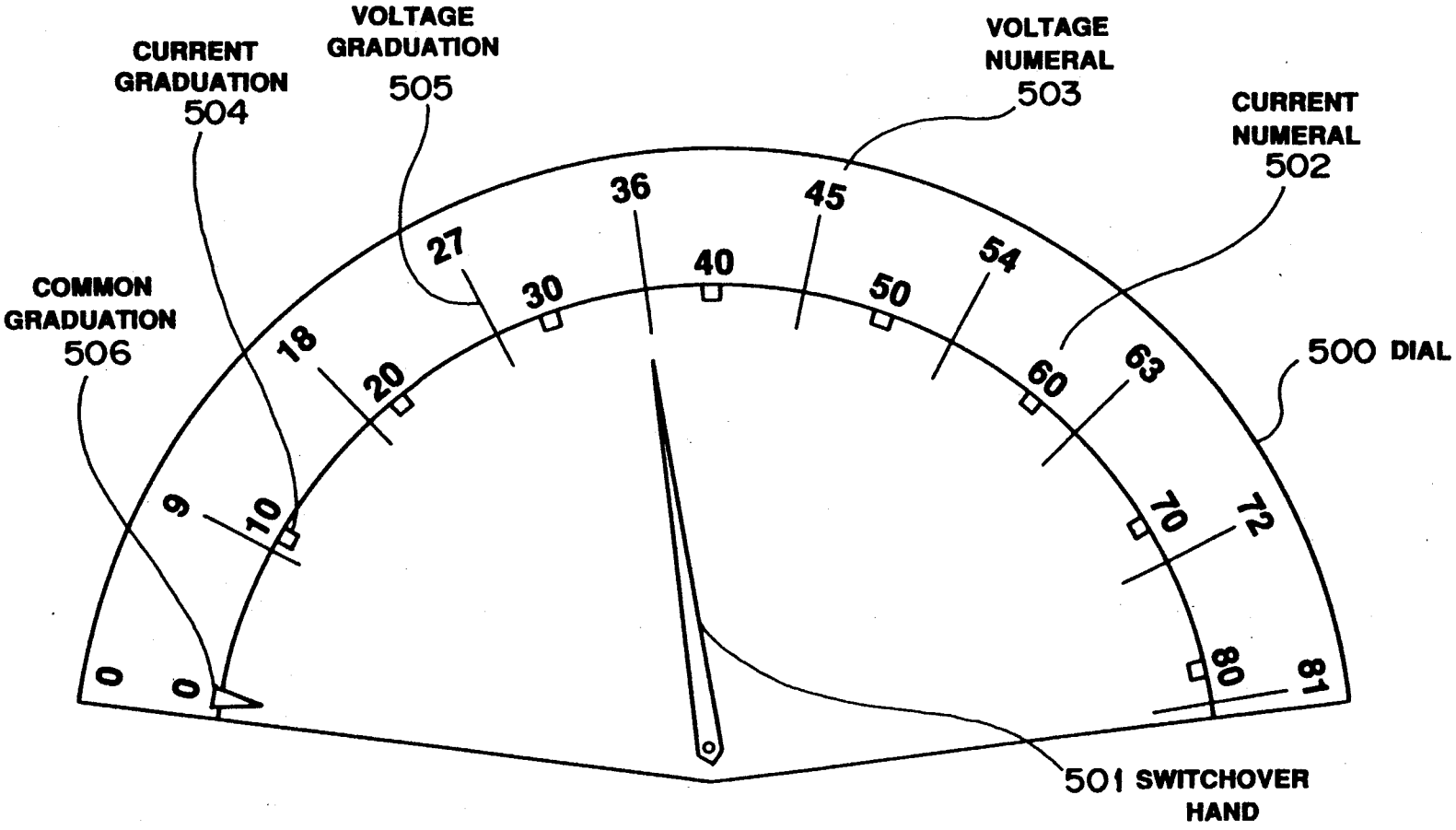
FIG. 12 is a plan view of a dial and a hand of a second embodiment of the present invention.
Figure 13:
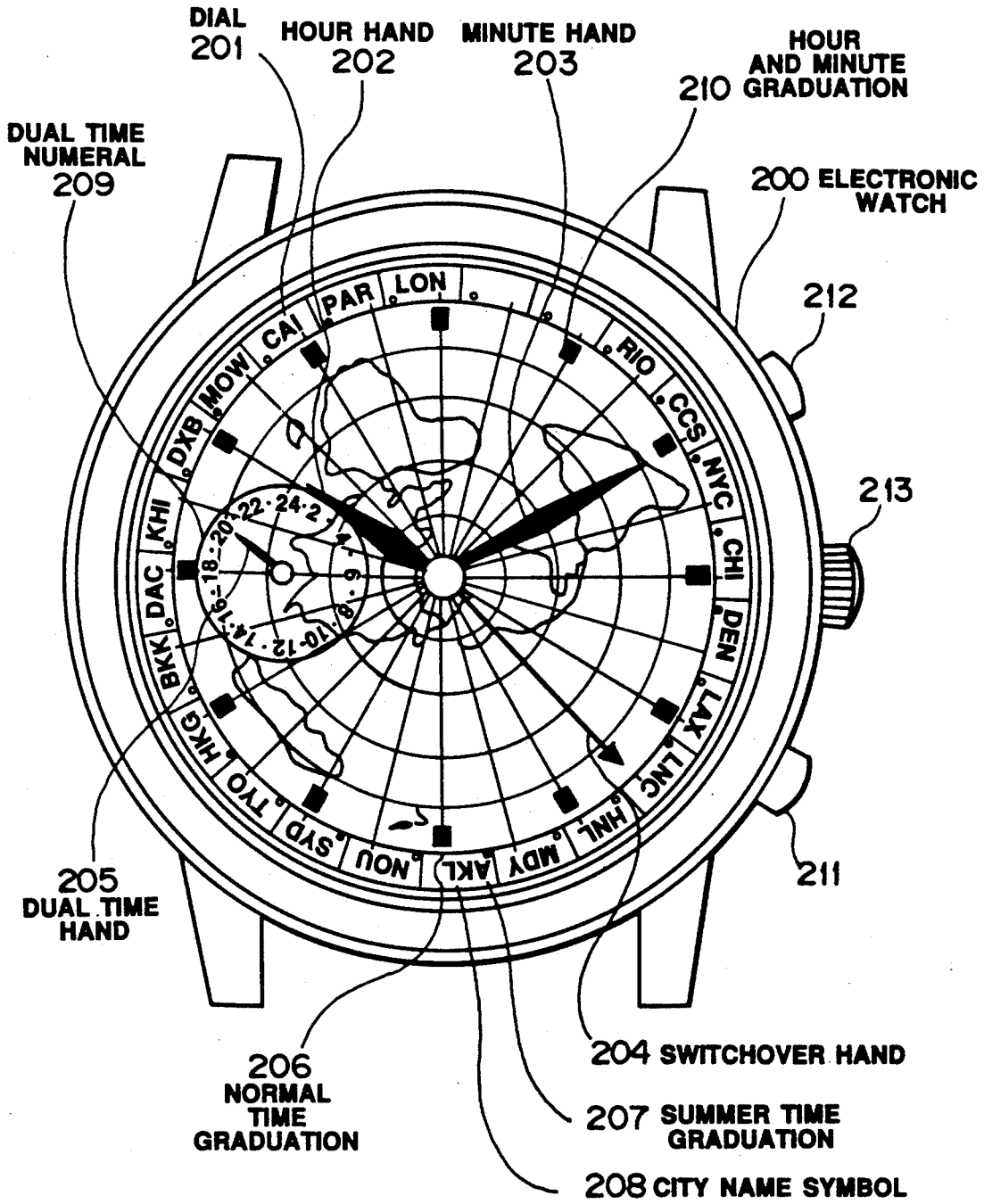
FIG. 13 is a plan view of a world watch of a hand type having a summer time display function according to a third embodiment of the present invention.
Figure 14:
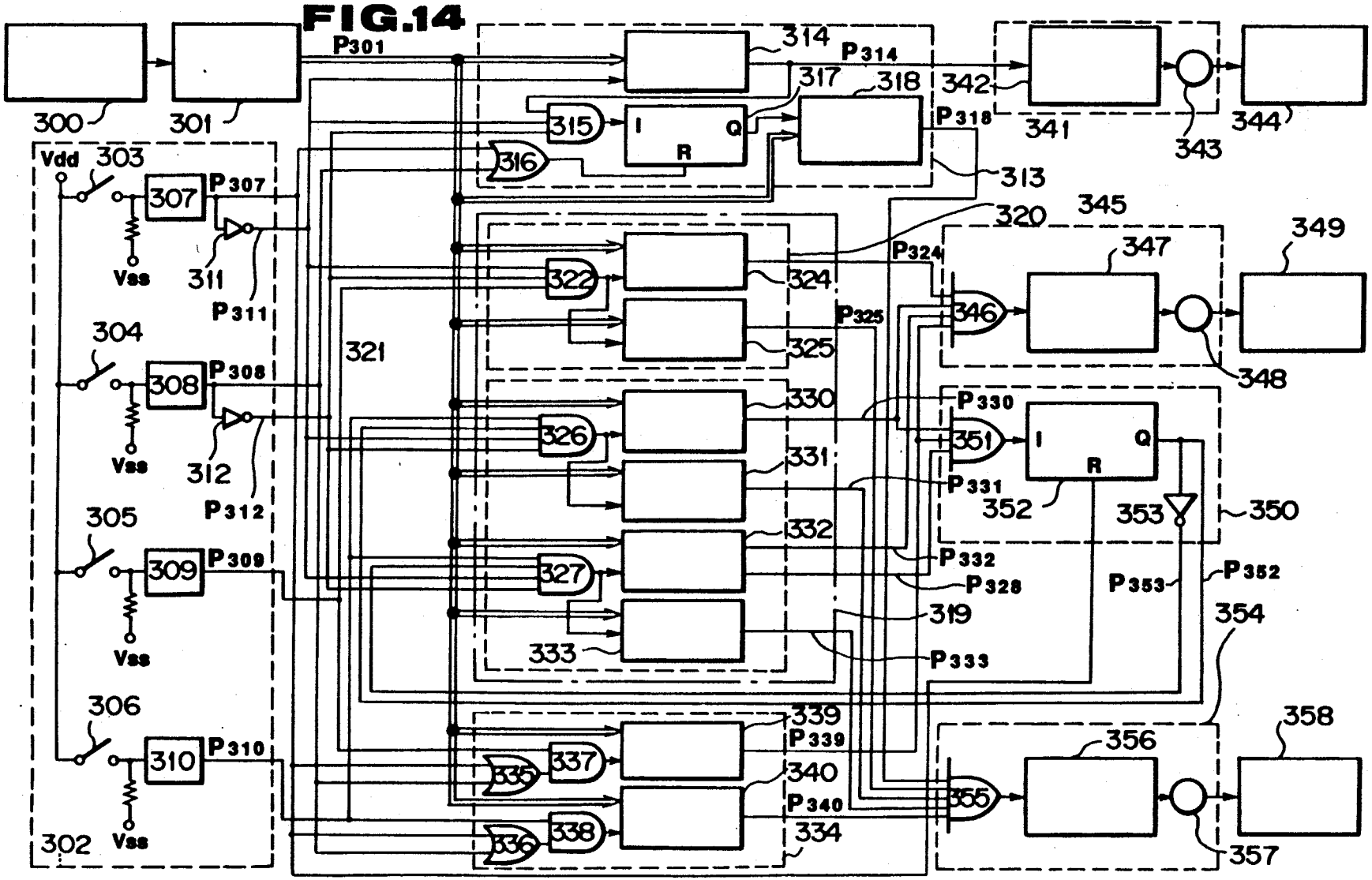
FIG. 14 is a circuit block diagram of the third embodiment.

In FIG. 12, current values and voltage values can be changeably measured and displayed, and the two modes (functions) of current and voltage are displayed by means of a single hand in a sector-shaped dial. In FIG. 12, 500 is a dial; 501 is a switchover hand; 502 is current numerals; 503 is voltage numerals; 504 is current graduations arranged in conformity with the positions of the current numerals 502; 505 is voltage graduations arranged in conformity with the positions of the voltage numerals 503; and 506 is a graduation common to two functions arranged in conformity with numeral "0" of the current numerals 502 and numeral "0" of the voltage numerals 503. The minimal display resolution of the current numerals 502 is 10 amperes, and that of voltage numerals 503 is 9 volts. In the display range smaller than 90 which is the least common multiple of 10 and 9, the numerals of the same order are used for two functions. As shown in FIG. 12, the dial 500 is sector-shaped and the numerals for the two functions are of the same order. As a result, if the current measuring function is 0 ampere and the voltage measuring function is 0 volt, that is, numerals "0's" exist for both functions, it would be more preferable that the graduation and numeral representing "0" occupy the same position. In FIG. 12, the switchover hand 501 points to "36" among the voltage numerals 503, that is, shows 36V. Of course, the present mode is the voltage measuring mode. As in FIG. 12, even if the graduations and numerals corresponding to the two functions are not equally spaced, the circuit configuration in which the hand stays at each position for a relatively long time can be easily realized by controlling pulse intervals of the driving signals, for example, with an ROM which stores the unequal interval graduation positions. Third Embodiment In the above two embodiments, the graduation or numeral which represents the zero point, i.e. the reference, occupies the same position. Next, a further embodiment is shown in FIGS. 13 and 14 in which the graduations or numerals for the first function and the graduations or numerals for the second function are arranged not to occupy the same positions. FIGS. 13 and 14 will be explained below.

FIG. 13 is a front view of the external appearance of an electronic hand watch provided with a world time function according to the present invention, wherein 200 is an electronic watch, and 201 is its dial, on which a world map viewed from the North Pole is printed.

At the side of the electronic watch 200, a crown 213, a time zone selection button 211 and normal-summer switchover button 212 are provided. By pulling out the crown (stem) 213 to the second position, a switch 303 (discussed later) is operated; by pulling out the crown (stem) 213 to the first position, a switch 304 (discussed later) is operated; by depressing the time zone selection button 211, a switch 305 (discussed later) is operated; and by depressing the normal-summer switchover button 212, a switch 306 (discussed later) is operated.

On the dial 201, an hour hand 202 and a minute hand 203 for normal time display are attached in the center of the dial and indicates the time together with hour and minute graduations 210 printed as a guide for reading the hour and minute. Also, a switchover hand 204 is attached in the center of the dial 201. This switchover hand 204 not only displays the indicated city together with its city name symbol 208 but also tells which function, the summer time or the normal time, is selected. The summer time function is used when the summer time is carried out in the city, while the normal time function is used when instead of the summer time, the normal time is carried out. To differentiate between the summer time and the normal time, the switchover hand 204 points to either any summer time graduation 207 which is an open circle or solid circle (solid circles for cities which carry out the summer time and open circles for cities which do not carry out the summer time) or any normal time graduation 206 which is a bar graduation. Also on the dial 201, a dual time hand 205 is attached as a smaller hand and indicates what time is the summer time or the normal time of the city pointed by the switchover hand 204, together with dual time numerals 209.

FIG. 14 is a circuit block diagram of the embodiment shown in FIG. 13. In FIG. 14, comprising elements are a time reference source 300; a frequency dividing circuit 301 which outputs a signal group of frequency division signals P301 to make the pulse period and pulse width for driving under the output signal of the reference source; a switching circuit 302; a time display means 313; a drive control circuit 319 including a time zone selection circuit 320 and a normal-summer switching circuit 321; a correction means 334; an hour and minute hand driving means 341; an hour and minute hand driving means 341; a switchover hand driving means 345; a switchover hand train and hand 349 which interlock with the switchover hand driving means 345; a mode control circuit 350; a dual time hand driving means 354; and a dual time train and hand 358 which interlock with the dual time hand driving means 354.

Furthermore, the switching circuit 302 comprises switches 303 to 306, chattering preventing circuits 307 to 310, and inverters (INVS) 311 and 312. When the crown 213 is in the second pull-out state, the circuit 307 produces a crown second pull-out signal P307. On the other hand, when the crown 213 is in any state other than the second pull-out state, the INV 311 produces an inverted crown second pull-out signal P311. Similarly, corresponding to a first pull-out position of the crown 213, the circuits 308 and 312 produce a crown first pull-out signal P308 and an inverted crown first pull-out signal P312. By depressing the time zone selection button 211 and the normal-summer switching button 212, the circuits 309 and 310 produce a first push signal P309 and a second push signal P310 each of one shot, respectively.

The time display means 313 comprises a time signal generating circuit 314, an AND 315, an OR 316, a 60-base counter 317, and a usual dual signal generating circuit 318.

The time zone selection circuit 320 comprises an AND 322, a zone change signal generating circuit 324, and a dual return signal generating circuit 325.

The normal-summer switching circuit 321 comprises ANDS 326 and 327, a normal shift signal generating circuit 330, a dual return signal generating circuit 331, a summer shift signal generating circuit 332, and a dual advance signal generating circuit 333.

The correction means 334 comprises ORS 335 and 336, ANDS 337 and 338, a switchover hand correction signal generating circuit 339, and a dual correction signal generating circuit 340.

The hour and minute hand driving means 341 comprises an hour and minute hand driving circuit 342, and a first motor 343 which is driven by an output signal of the circuit 342.

The switchover hand driving means 345 comprises an OR 346, a switchover hand driving circuit 347 which receives an output signal of the OR 346, and a second motor 348 which is driven by an output signal of the circuit 347.

The mode control circuit 350 comprises an OR 351, a binary counter 352, and an inverter (INV) 353. From an output terminal Q of the binary counter 352, under an output signal of the OR 351 applied to an input terminal I and the crown second pull-out signal P307 applied to a reset input terminal R, a summer mode signal P352 is produced when the summer time function is selected. On the other hand, from the INV 353, a normal mode signal P353 is produced when the normal time function is selected.

The dual time hand driving means 354 comprises an OR 355, a dual hand driving circuit 356 which receives an output signal of the OR 355, and a third motor 357 which is driven by an output signal of the circuit 356.

Next, operation of the circuit block diagram of FIG. 14 will be described.

In the watch specifications of this embodiment, by rotating the crown 213 in the crown second pull-out state, the normal time correction of the hour hand 202 and the minute hand 203 and the initialization correction of the switchover hand 204 are mechanically made. In the crown first pull-out state, the world time correction is made to set the switchover hand 204 and the dual time hand 205 for the dual time of an optional city. In the normal use condition of the crown rest state, the following operations can be performed. A time zone selection operation for telling the dual time of the appointed zone by selecting the time zone, and a normal-summer switching operation for switching the normal time function and the summer time function.

In the crown second pull-out state, when the first push signal P307 is produced from the switching circuit 302, the crown second pull-out signal P309 which is one of the input signals of the OR 335 is produced in the correction means 334. Accordingly, the output signal of the OR 335 which is one of the input signals of the AND 337 is at the "H" level, and the first push signal P309 which is the other input signal of the AND 337 is produced. From the switchover hand correction signal generating circuit 339, In accordance with the timing of the first push signal P309 from the AND 337 and under the fixed frequency division signal P301, the switchover hand correction signal P339 of a one-shot signal is produced to drive the switchover hand 204 by one shot in the forward direction. The signal P339 is applied to the switchover hand driving means 345, and the switchover hand 204 is driven by one shot in the forward direction. On the other hand, the mode control circuit 350 is also supplied with the switchover correction signal P339, the binary counter of the mode control circuit 350 is reset by the crown second pull-out signal P307, and the normal mode signal P353 from the INV 353 is kept produced. That is to say, when the user makes an initialization correction to set the switchover hand 204 at any normal time graduation 206 which is a bar graduation of any city as an initial setting, the switchover hand 204 and the mode control circuit 350 are in phase with each other.

In the crown second pull-out state, other circuits such as the time display means 313 and the drive control circuit 319 do not operate.

When, in the crown first pull-out state, the first push signal P309 is produced from the switching circuit 302, then in the correction means 334, the crown first pull-out signal P308 which is one of the input signals of the OR 335 is produced, and as in the crown second pull-out state, under the switchover hand correction signal P339, the switchover hand 204 is driven by one shot in the forward direction. However, the mode control circuit 350 is not reset in the crown first pull-out state, and the switchover hand correction signal P339 is supplied at that time. As a result, the output level of the binary counter 352 is inverted. That is to say, in the event that the normal mode signal P353 has been produced until that time, it is switched to produce the summer mode signal P352, and in the event that the summer mode signal P352 has been produced until that time, it is switched to produce the normal mode signal P353 so that every depressing operation the switchover hand 204 always points to any normal time graduation 206 and any summer time graduation 207 alternately and then can be corrected. Also, when the second push signal P310 is produced from the switching circuit 302 in the crown first pull-out state, the second push signal P310 which is the other input signal is outputted from the AND 338 in the correction means 334 because the output of the OR 336 which is one of the input signals of the AND 338 is at the "H" level by the crown first pull-out signal P308. The dual correction signal generating circuit 340 produces the dual correction signal P340 which is a one-shot signal for driving the dual time hand 205 by one shot in the forward direction by the timing of the second push signal P310 from the AND 338 and under the fixed frequency division signal P301, and the signal P340 is applied to the dual time hand driving means 354. Thus the dual time hand 205 is driven by one shot in the forward direction. That is to say, by depressing the two buttons 211 and 212 in the crown first pull-out state, the dual time can be set, considering that in the city to be set, the summer time is now carried out.

Also, when the crown is in the crown first pull-out state, the time signal generating circuit 314 produces a time signal P314 at an interval of one minute under the fixed frequency division signal P301 because at the time, the inverted crown second pull-out signal P311 from the switching circuit 302 is at the "H" level and the circuit 314 is put in the output enable state, and the time signal 314 is applied to the hour and minute hand driving means 341. As a result, the minute hand 203 is driven by one minute and the hour hand 202 is interlocked.

In the crown first pull-out state, the drive control circuit 319 does not operate.

Next, operation of the time display means 313 in the crown rest state will be described. The time signal generating circuit 314 operates in the same way as in the crown first pull-out state. As a result, the minute hand 203 is driven by one minute and the hour hand 202 is interlocked. The inverted crown first pull-out signal P312 and the inverted crown second pull-out signal P311 from the switching circuit 302 which are the first and second input signals of the AND 315 are both at the "H" level. A time signal P314 at an interval of one minute which is the third input signal of the AND 315 from the time signal generating circuit 314 is produced from the AND 315. The crown second pull-out signal P307 and the crown first pull-out signal P308 which are the first and second input signals from the switching circuit 302 are both at the "L" level. The output signal from the OR 316 to an input terminal R of the base-60 counter 317 is at the "L" level, and a reset operation of the base-60 counter 317 is not performed. Under the time signal P314 from the AND 315 to the input terminal I of the base-60 counter 317, the base-60 counter 317 performs a counting operation at an interval of one minute and produces a 1-hour signal P317 from an output terminal Q thereof after the time signal P314 is counted 60 times. The usual dual signal generating circuit 318 produces a usual dual signal P318 at an interval of one hour by the timing of the 1-hour signal P317 and under the fixed frequency division signal P301. The signal P318 is applied to the dual time hand driving means 354. The dual time hand 205 is driven by one hour to indicate what time the dual time is.

Next, operation of the drive control circuit 319 in the crown rest state which is the most important part in this embodiment will be described.

First, operation related to the time zone selection circuit 320 will be described. In the crown rest state, when the time zone selection button 211 is depressed, the inverted crown first pull-out signal P312 and the inverted crown second pull-out signal P311 from the switching circuit 302 which are the first and second input signals of the AND 322 are both at the "H" level. The first push signal P309 from the switching circuit 302 which is the third input signal is produced from the AND 322. By the timing of the first push signal P309 and under the fixed frequency division signal P301, the zone change signal generating circuit 324 produces a zone change signal P324 which is a two-shot drive signal (the interval between the two one-shot signals is about 30 ms) for driving the switchover hand 204 by two shots in the forward direction. The signal P324 is applied to the switchover hand drive means 345. In the event that the switchover hand 204 indicates any normal time graduation 206 of a certain city, it looks to human eyes as if the switchover hand 204 moved to the normal time graduation 206 of the next city at a time, and in the event that the switchover hand 204 indicates any summer time graduation 207 of a certain city, it looks to human eyes as if the switchover hand 204 moved to the summer time graduation 207 of the next city at a time. Thus, the zone is changed. At this time, the relation between the normal time selected state and the summer time selected state is not switched, and it is unnecessary to change the mode control circuit 350.

Also, by the timing of the first push signal P309 from the AND 322 and under the fixed frequency division signal P301, the dual return signal generating circuit 325 drives the dual time hand 205 by one shot in the reverse direction. The signal P325 is applied to the dual time hand driving means 354. The dual time hand 205 follows the motion of the switchover hand 204 to the next western time zone city and is reversed by one shot. Thus, the dural time display is returned one hour.

Operation of the normal-summer switching circuit 321 will be described below.

First, in the crown rest summer time function selection state, the summer mode signal P352 from the mode control circuit 350, the inverted crown second pulll-out signal P311 from the switching circuit 302 and the inverted crown first pull-out signal P312 from the switching circuit 302 which are the first, second and third input signals of the AND 326 are all at the "H" level. Therefore, when the normal-summer switching button 212 is depressed and the second push signal P310 from the switching circuit 302 which is the fourth input signal of the AND 326 is produced, the normal time shift signal generating circuit 330 produces a normal shift signal P330 which is a one-shot signal for driving the switchover hand 204 by one shot in the forward direction by the timing of the second push signal P310 from the AND 326 and under the fixed frequency division signal P301. The signal P330 is applied to the switchover hand driving means 345. The switchover hand 204 is driven by one shot in the forward direction. The switchover hand 204 shifts from the summer time graduation 207 to the normal time graduation 206 of the same city. The normal shift signal P330 is also applied to the mode control circuit 350. The binary counter 352 is inverted, and instead of the summer mode signal P352, the normal mode signal P353 is produced to change the mode. Also, by the timing of the second push signal P310 and under the fixed frequency division signal P301, the dual return signal generating circuit 331 produces the dual return signal P331 for driving the dual time hand 205 by one shot in the reverse direction. The signal P331 is applied to the dual time hand driving means 354. The dual time hand follows the shift of the switchover hand 204 to the normal time graduation 206 and thus is reversed by one shot. The dual time display returns one hour.

Furthermore, in the normal time function selection state of the crown rest position, the normal mode signal P353 from the mode control circuit 350, the inverted crown second pull-out signal P311 and the inverted crown first pull-out signal P312 from the switching circuit 302 which are the first, second and third input signals of the AND 327 are all at the "H" level. As a result, when the normal-summer switch button 212 is depressed, the second push signal P310 from the switching circuit 302 which is the fourth input signal of the AND 327 is produced from the AND 327. Therefore, the summer shift signal generating circuit 332 produces the summer shift signal P332 which is a one-shot signal for driving the switchover hand 204 by one shot in the reverse direction by the timing of the second push signal P310 from the AND 327 and under the fixed frequency division signal P301. The signal P332 is applied to the switchover hand driving means 345, and the switchover hand 204 is driven by one shot in the reverse direction and shifts from the normal time graduation 206 to the summer time graduation 207 of the same city. In synchronization with the output of the normal shift signal P330, the summer shift signal generating circuit 332 produces an inverted count signal P328 which is a one-shot signal. The signal P328 is applied to the mode control circuit 350. The binary counter 352 is inverted, and instead of the normal mode signal P353, the summer mode signal P352 is produced to change the mode. By the timing of the second push signal P310 from the AND 327 and under the fixed frequency division signal P301, the dual advance signal generating circuit 333 produces a dual advance signal P333 for driving the dual time hand 205 by one shot in the forward direction. The signal P333 is applied to the dual time hand driving means 354. The dual time hand 205 follows the shift of the switchover hand 204 to the summer time graduation 207 and is forwarded one shot. The dual time display advances one hour.

As mentioned above, the normal time graduations 206 for the first function and the summer time graduations 207 for the second function on the dial 201 are arranged so as not to occupy the same positions. For controlling the zone change by means of the time zone selection button 211 in the crown rest state, the rising time interval is controlled by the zone change signal P324 of the drive control circuit 319 so that every operation, the switchover hand shifts the position of the graduation corresponding to the function now selected by one zone and stays there until the next operation, and stays for a short time of about 30 ms at the position of the graduation corresponding to the function now unselected. Therefore, it looks to human eyes as if the switchover hand 204 moved between the positions of the graduations corresponding to the function now selected. Other Embodiments or Variations In the three embodiments mentioned above, there are two modes (functions), and the arrangements of graduations or numerals alternate. However, this invention includes three or more modes (functions), an unalternate relation of the respective modes and an arrangement apparently at random. It is unnecessary to space equally graduations and numerals corresponding to the selected one function, and the circuit configuration in which the graduations and numerals are unequally spaced and the hand stays at those positions for a long time can be easily realized by controlling pulse intervals of driving signals, for example, with an ROM which stores the unequal interval graduation positions.

The embodiments for three display forms have been described, and other embodiments or variations will be discussed below.

(1) In a plurality of systems of graduations or numerals corresponding to a plurality of functions, the common graduation does not necessarily correspond to numeral "0", and a proper reference value is selected for convenience of use such as readability of the display. For example, in the case where temperature and humidity are changeably displayed, numeral "100" is commonly used. Since it corresponds to a temperature of 100° C. and a humidity of 100%, there is a ruled reference, and since a temperature of 100° C. will not usually happen, there is no confusion. In another embodiment, for two quantities logarithmically indicated (e.g. sound pressure in area different in frequencies), numeral "1" (the logarithmic value is zero) is used for the common display.

(2) In the embodiments, a plurality of display systems are "graduations or numerals". This does not strictly define the meaning. Symbols and marks are included as serving as graduations.

(3) Three or more display systems can be installed unless readability is extremely impaired.

Industrial Usability

According to the present invention, in a hand display device in which a single hand is switched to two or more functional displays for use, the reference graduation or numeral on the dial to which the hand is attached occupies the common position, and the other graduations or numerals are arranged so that those for the first function and those for the second function do not occupy the same positions. In the graduations or numerals other than the reference graduation or numeral, when one of the functions is selected, the hand will not substantially stay at any graduation or numeral corresponding to the other function. Thus, in a mode hand of an electronic hand display watch or a pointer such as a switch knob for mode display of a hand indicating terster, the display value can be correctly read without the need for a readout discriminating means for discriminating which functional graduation or numeral should be read. This will reduce the cost of a hand display device having a hand which is switched to more than one function. Thus not only a low cost hand display device can be provided, but also any error of reading information is eliminated and display space can be effectively used by a small number of hands. Furthermore, since the reference graduation or numeral for more than one function occupies the same position and is used in common, the effects of improved design of device and readability are produced by avoiding the complication of arrangement of numerals or graduations. Thus this invention has very wide application.

We claim:

1. A hand display device with a hand for changeably displaying one display value of a first function and another display value of a second function, a dial having said hand attached therereto and graduations or symbols for said first function and second fucntion, respectively, and a driving means for said hand, said driving means comprising a first function signal generating circuit for generating a first function signal, and a second function signal generating circuit for generating a second function signal, a mode control circuit for generating a mode switching signal for changing from one display value of said first function to another display value of said second function, a drive control circuit for selectively producing mutually different drive control signals under a first function signal when said mode switching signal is in a first state and under a second function signal when said mode switching signal is in a second state, a drive circuit for producing a drive signal under said drive control signal, and a pulse motor for receiving said drive signal from said drive circuit and interlocking with said hand, said graduations or symbols for said first function and said graduations or symbols for said second function on said dial being arranged substantially not to occupy the same positions, and an occurrence time interval of said drive signal being controlled so that said hand stays at a position of a graduation or symbol corresponding to a selected function among said graduations or symbols for a relatively longer time than at a position of a graduation or symbol corresponding to an unselected function and so that said hand passes a position of a graduation or symbol corresponding to an unselected function in a relatively shorter time than a position of a graduation or symbol corresponding to a selected function.

2. A hand display device with a hand for changeably displaying one display value of a first function and another display value of a second function, a dial having said hand attached thereto and graduations or symbols for a first function and second function respectively, and a driving means for said hand, said driving means comprising:

a mode control circuit for generating a mode switching signal in response to a change from one display value of said first function to another display value of second function, a drive control circuit for producing a first function signal when said mode switching signal is in a first state and a second function signal when said mode switching signal is in a second state, a drive circuit for producing a drive signal under one signal which is being produced of said first and second function signals, and a pulse motor for receiving said drive signal from said drive circuit and interlocking with said hand, said graduations or symbols for said first function and said graduations or symbols for said second function on said dial being arranged substantially not to occupy said same positions, and said drive control circuit having a function for controlling an occurrence interval of said drive signal so that said hand stays at a position of a graduation or symbol corresponding to a selected function among said graduations or symbols for a relatively longer time than at position of a graduation or symbol corresponding to an unselected function and so that said hand passes a position of a graduation or symbol corresponding to an unselected function in a relatively shorter time than a position of a graduation or symbol corresponding to a selected function.

3. A hand display device according to claim 2, in which said hand display device comprises world time display means comprising:

a first function for displaying normal time mode, and a second function for displaying summer time mode of a selected city of the world, said dial comprises city and time mode display dial comprising:

a plurality of city name symbols, normal time graduation, summer time graduation, and dual time display dial comprising a plurality of numerals, said hand comprises:

a switchover hand provided in the center of the city and time mode display dial for displaying the name of a selected city and selected time mode of the city, and a dual time hand provided in the center of said dual time display portion for displaying a time in the selected time mode of the selected city, and said driving means comprises:

a switchover hand driving means for driving said switchover hand, and a dual time hand driving means for driving said dual time hand, and said normal time graduations and said summer time graduations are arranged so as not to occupy the same position, and when city selection operation is performed after one of said normal and summer time modes is selected, said switchover hand is controlled by said drive control circuit so that every operation, said switchover hand shifts a position of the graduations corresponding to now selected time mode and stays there until a next operation, and stays for a short time at a position of the graduations corresponding to now unselected time mode.

4. A hand display device according to claim 2 in which said graduations or symbols corresponding to said first function and said graduations or symbols corresponding to said second function are common in position of a reference point.

5. A hand display device according to claim 2 in which said first function and second function are display functions of a plurality of time system information different in time interval.

6. A hand display device according to claim 2 in which said first function and second function are functions for displaying a plurality of physical quantities having different dimensions from each other.

* * * * *

UNITED STATES PATENT AND TRADEMARK OFFICE

CERTIFICATE OF CORRECTION

PATENT NO. : 5,195,062

DATED : March 16, 1993

INVENTOR(S) : Masahiro Sase et al.

It is certified that error appears in the above-identified patent and that said Letters Patent is hereby corrected as shown below:

On the Title page,

Item: [54] Title of Invention: Change "DISPLAY DEVICE" to --HAND DISPLAY DEVICE--

Signed and Sealed this

Seventh Day of December, 1993

*Attest:*

Bruce Lehman

BRUCE LEHMAN

*Attesting Officer*

*Commissioner of Patents and Trademarks*